US010263336B1

(12) United States Patent
Wong et al.

(10) Patent No.: US 10,263,336 B1
(45) Date of Patent: Apr. 16, 2019

(54) MULTI-BAND MULTI-ANTENNA ARRAY

(71) Applicant: Industrial Technology Research Institute, Hsinchu (TW)

(72) Inventors: Kin-Lu Wong, Hsinchu (TW); Wei-Yu Li, Hsinchu (TW); Chih-Yu Tsai, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 15/855,601

(22) Filed: Dec. 27, 2017

(30) Foreign Application Priority Data

Dec. 8, 2017 (TW) ..... 106143155 A

(51) Int. Cl.
*H01Q 1/48* (2006.01)
*H01Q 5/35* (2015.01)
(Continued)

(52) U.S. Cl.
CPC ..... *H01Q 5/35* (2015.01); *H01Q 1/48* (2013.01); *H01Q 7/00* (2013.01); *H01Q 9/0457* (2013.01); *H01Q 21/065* (2013.01); *H01Q 1/243* (2013.01)

(58) Field of Classification Search
CPC .. H01Q 5/35; H01Q 1/48; H01Q 7/00; H01Q 9/04; H01Q 21/06; H01Q 1/24
(Continued)

(56) References Cited

U.S. PATENT DOCUMENTS 4,460,899 A 7/1984 Schmidt et al.
5,952,983 A 9/1999 Dearnley et al.
(Continued)

FOREIGN PATENT DOCUMENTS

CN 103229356A A 7/2013
CN 104393398B B 5/2017
(Continued)

OTHER PUBLICATIONS

Ding, Y., "A Novel Dual-Band Printed Diversity Antenna for Mobile Terminals" IEEE Transactions on Antennas and Propagation, Jul. 2007, pp. 2088-2096, US.
(Continued)

*Primary Examiner* — Andrea Lindgren Baltzell
(74) *Attorney, Agent, or Firm* — Mintz Levin Cohn Ferris Glovsky and Popeo, P.C.; Peter F. Corless; Steven M. Jensen

(57) ABSTRACT

A multi-band multi-antenna array includes a ground conductor plane and a dual antenna array. The ground conductor plane includes a first edge and separates a first side space and a second side space. The dual antenna array has a maximum array length extending along the first edge and includes a first antenna and a second antenna. The first antenna includes a first resonant loop and a first radiating conductor line exciting the first antenna generating a first resonant mode and a second resonant mode, respectively, wherein frequencies of the first resonant mode are lower than frequencies of the second resonant mode. The second antenna includes a second resonant loop and a second radiating conductor line exciting the first antenna generating a third resonant mode and a fourth resonant mode, respectively, wherein frequencies of the third resonant mode are lower than frequencies of the fourth resonant mode.

15 Claims, 13 Drawing Sheets

(51) Int. Cl.

| | |
|---|---|
| ***H01Q 21/06*** | (2006.01) |
| ***H01Q 9/04*** | (2006.01) |
| ***H01Q 7/00*** | (2006.01) |
| *H01Q 1/24* | (2006.01) |

(58) Field of Classification Search
USPC ..... 343/867
See application file for complete search history.

(56) References Cited

U.S. PATENT DOCUMENTS

| | | | | |
|---|---|---|---|---|
| 5,990,838 | A | 11/1999 | Bums et al. | |
| 6,104,348 | A | 8/2000 | Karlsson et al. | |
| 6,288,679 | B1 | 9/2001 | Fischer et al. | |
| 6,344,829 | B1 | 2/2002 | Lee | |
| 6,426,723 | B1 | 7/2002 | Smith et al. | |
| 6,549,170 | B1 | 4/2003 | Kuo et al. | |
| 6,583,765 | B1 | 6/2003 | Schamberger et al. | |
| 6,624,789 | B1 | 9/2003 | Kangasvieri et al. | |
| 6,624,790 | B1 | 9/2003 | Wong et al. | |
| 7,250,910 | B2 | 7/2007 | Yoshikawa et al. | |
| 7,271,777 | B2 | 9/2007 | Yuanzhu | |
| 7,289,068 | B2 | 10/2007 | Fujio et al. | |
| 7,330,156 | B2 | 2/2008 | Arkko et al. | |
| 7,352,328 | B2 | 4/2008 | Moon et al. | |
| 7,385,563 | B2 | 6/2008 | Bishop | |
| 7,405,699 | B2 | 7/2008 | Qin | |
| 7,460,069 | B2 | 12/2008 | Park et al. | |
| 7,498,997 | B2 | 3/2009 | Moon et al. | |
| 7,541,988 | B2 | 6/2009 | Sanelli et al. | |
| 7,561,110 | B2 | 7/2009 | Chen | |
| 7,573,433 | B2 | 8/2009 | Qin | |
| 7,586,445 | B2 | 9/2009 | Qin et al. | |
| 7,609,221 | B2 | 10/2009 | Chung et al. | |
| 7,688,273 | B2 | 3/2010 | Montgomery et al. | |
| 7,710,343 | B2 | 5/2010 | Chiu et al. | |
| 7,714,789 | B2 | 5/2010 | Tsai et al. | |
| 7,733,285 | B2 | 6/2010 | Gainey et al. | |
| 2005/0140551 | A1 | 6/2005 | Kaluzni et al. | |
| 2009/0322639 | A1 | 12/2009 | Lai | |
| 2010/0134377 | A1 | 6/2010 | Tsai et al. | |
| 2010/0156726 | A1 | 6/2010 | Montgomery et al. | |
| 2010/0156745 | A1 | 6/2010 | Andrenko et al. | |
| 2010/0156747 | A1 | 6/2010 | Montgomery | |
| 2010/0238079 | A1 | 9/2010 | Ayatollahi et al. | |
| 2010/0295736 | A1 | 11/2010 | Su | |
| 2010/0295750 | A1 | 11/2010 | See et al. | |
| 2011/0019723 | A1 | 1/2011 | Lemer et al. | |
| 2013/0162496 | A1* | 6/2013 | Wakabayashi | H01Q 21/00 343/853 |
| 2013/0234896 | A1* | 9/2013 | Sharawi | H01Q 9/0421 343/700 MS |
| 2013/0234902 | A1 | 9/2013 | Asanuma et al. | |
| 2017/0162948 | A1 | 6/2017 | Wong et al. | |

FOREIGN PATENT DOCUMENTS

| | | | |
|---|---|---|---|
| TW | 200737600 | A | 10/2007 |
| TW | 201114101 | A | 4/2011 |

OTHER PUBLICATIONS

Concurrent Dual-Band Six-Loop-Antenna System with Wide 3-dB Beamwidth Radiation for MIMO Access Points, Saou-Wen Su, Microwave and Optical Technology Letters, Jun. 2010, vol. 52, pp. 1253-1258.

Compact Mobile Handset MIMO Antenna for LTE700 Application, Hongpyo Bae, Frances J. Harackiewicz, Myun-Joo Park, Taekyun Kim, Microwave and Optical, Technology Letters, Nov. 2010, vol. 52, pp. 2419-2422.

MIMO Antenna Using a Decoupling Network for 4G USB Dongle Application, Minseok Han and Jaehoon Choi, Microwave and Optical Technology Letters Nov. 2010, vol. 52, pp. 2551-2554.

Design of a Dual-Band MIMO Antenna for Mobile WiMAX Application Dongho Kim, Uisheon Kim ,Microwave and Optical Technology Letters, Feb. 2011 , vol. 53, pp. 410-414.

A Decoupling Technique for Increasing the Port Isolation Between Two Strongly Coupled Antennas, Shin-Chang Chen Yu-Shin Wang, IEEE Transactions on Antennas and Propagation, Dec. 2008, vol. 56, pp. 3650-3658.

MIMO Handheld Antenna Design Approach Using Characteristic Mode Concepts, Jonathan Ethier, Eric Lanoue and Derek, Microwave and Optical Technology Letters, Jul. 2008, vol. 50, pp. 1724-1727.

Internal Wideband Monopole Antenna for MIMO Access-Point Applications in the WLAN/WiMAX Bands, Jui-Hung Chou and Saou-WenSu, Microwave and Optical Technology Letters, May 2008, vol. 50, pp. 1146-1148.

Printed Coplanar Two-Antenna Element for 2.4/5 GHz WLAN Operation in a MIMO System, Saou-Wen Su, and Jui-Hung Chou Microwave and Optical Technology Letters Jun. 2008, vol. 50, pp. 1635-1638.

A Novel Wideband Diversity Antenna for Mobile Handsets, Yaxing Cai, Zhengwei Du, Microwave and Optical Technology Letters, Jan. 2009, vol. 51, pp. 218-222.

Performance Evaluation of 2 × 2 Mimo Handset Antenna Arrays for Mobile WiMAX Applications, Jung-Hwan Choi, Yong-Sun Shin, Microwave and Optical Technology Letters Jun. 2009, vol. 51, pp. 1558-1561.

A Three-In-One Diversity Antenna System for5 GHz WLAN Applications, Saou-Wen Su , Microwave and Optical Technology Letters, Oct. 2009, vol. 51, pp. 2477-2481.

Isolation Improvement of 2.4/5.2/5.8 GHz WLAN Internal Laptop Computer Antennas Using Dual-Band Strip Resonator as a Wavetrap, Ting-Wei Kang and Kin-Lu Wong, Microwave and Optical Technology Letters, Jan. 2010, vol. 52, pp. 58-64.

Compact Multiport Antenna with Isolated Ports J. C. Coetzee and Y. Liu, Microwave and Optical Technology Letters, Jan. 2006 vol. 50, pp. 229-232.

A Compact Wideband Planar Diversity Antenna for Mobile Handsets, Qingyuan Liu, Zhengwei Du, Ke Gong and Zhenghe, Microwave and Optical Technology Letters, Jan. 2008, vol. 50, pp. 87-91.

* cited by examiner

MULTI-BAND MULTI-ANTENNA ARRAY

CROSS-REFERENCE TO RELATED APPLICATION

The present disclosure is based on, and claims priority from, Taiwan Application Number 106143155, filed Dec. 8, 2017, the disclosure of which is hereby incorporated by reference herein in its entirety.

BACKGROUND

1. Technical Field

The present disclosure relates to the technical field of a multi-band multi-antenna array design, and, more particularly, to a compact multi-band multi-antenna array design architecture that increases the data throughput of a communication device at different communication frequency bands.

2. Description of Related Art

The increasing demands for better signal quality and higher data throughput in wireless communication have led to the rapid development of Multi-Input Multi-Output (MIMO) system technology for handheld communication device. A handheld communication device configured with a MIMO multi-antenna system could benefit from higher spectral efficiency, channel capacities, and data throughput. The MIMO system could also improve receiving signal reliability at the handheld communication device. Thus, it has become one of the promising technologies for next-generation Multi-Gbps mobile communication system applications.

However, it remains a challenge to realize and integrate a MIMIO multi-antenna array system into a space-limited handheld communication device and also achieve good radiation efficiency for each antenna. This would be an important issue needed to be solved in the near future. Therefore, when a plurality of antennas operating in the same frequency band are co-designed and integrated in a handheld communication device with limited space, envelop correlation coefficients (ECCs) between the plurality of antennas would greatly increase, resulting in attenuation of antenna radiation performance and a reduction on data transmission throughput. This increases difficulty and challenge in multiple antenna integration design. In addition, different countries may choose to use different MIMO communication bands, adding in the fact that future MIMO wireless communication network and MIMO mobile communication network may also choose to use different frequency bands for data-link, a handheld communication device would need to integrate all of these multi-band operation in practical implementation. Moreover, a handheld communication device would also need to integrate multi-band carrier aggregation (CA) function in practical applications. These all increase the design complexity and difficulty in implementing a MIMO multi-antenna array. In view of the foregoing, not only the challenge of designing a highly integrated MIMO multi-antenna array in the future handheld communication device needs to be overcome, there also remains the question of how to design a MIMO multi-antenna array to enable operations at a plurality of different communication bands.

Some prior-art publications have proposed the design of protruding or notched structures on the ground planes between neighboring antennas as energy isolators to increase energy isolation between neighboring antennas. However, such a method may result in the excitation of additional coupling current, thereby increasing the correlation coefficient between the neighboring antennas, and in turn increasing the design complexity of multi-band decoupling for MIMO antenna array, resulting in a potential increase of the overall size of the MIMO antenna array. Therefore, it is difficult to achieve both high performance and a compact MIMO antenna array design in a handheld communication device. It is also not easy to overcome the technical difficulty in multi-band decoupling.

Therefore, there is a need for a compact multi-band multi-antenna array that addresses the need for wireless high data rate transmission at different communication frequency bands in future handheld communication devices.

SUMMARY

The present disclosure provides a multi-band multi-antenna array architecture.

According to an embodiment, the present disclosure proposes a multi-band multi-antenna array, which may include a ground conductor plane and a dual antenna array. The ground conductor plane separates a first side space and a second side space opposite to the first side space, and includes a first edge. The dual antenna array is at the first edge having a maximum array length extending along the first edge. The dual antenna array may include a first antenna and a second antenna. The first antenna is in the first side space, and may include a first resonant loop and a first radiating conductor line. The first resonant loop is formed by connecting a first signal source, a first feeding conductor line, a first capacitive coupling portion, a first resonant conductor line, a first inductive grounding conductor portion, and the first edge in series. The first radiating conductor line is electrically connected with the first resonant conductor line. The first resonant conductor line is disposed between the first capacitive coupling portion and the first inductive grounding conductor portion. The first resonant loop is configured to excite the first antenna generating a first resonant mode, and the first radiating conductor line is configured to excite the first antenna generating a second resonant mode. The frequencies of the first resonant mode are lower than those of the second resonant mode. The second antenna is in the second side space, and may include a second resonant loop and a second radiating conductor line. The second resonant loop is formed by connecting a second signal source, a second feeding conductor line, a second capacitive coupling portion, a second resonant conductor line, a second inductive grounding conductor portion, and the first edge in series. The second radiating conductor line is electrically connected with the second resonant conductor line. The second resonant conductor line is disposed between the second capacitive coupling portion and the second inductive grounding conductor portion. The second resonant loop is configured to excite the second antenna generating a third resonant mode and the second radiating conductor line is configured to excite the second antenna generating a fourth resonant mode. The frequencies of the third resonant mode are lower than those of the fourth resonant mode. The connection line of centers of the first resonant conductor line and the second resonant conductor line intersects the connection line of centers of the first radiating conductor line and the second radiating conductor line. The first resonant mode and the third resonant mode cover at least one identical first communication band, and the second resonant mode and the fourth resonant mode cover at least one identical second communication band. The frequency of the first communication band is less than that of the second communication band, and the maximum array length of the dual antenna array extending along the first edge is between 0.1 wavelength and 0.33 wavelength of the lowest operating frequency of the first communication band.

In order to assist better understanding of the above and other features of the present disclosure, exemplary embodiments are described in details below with reference made to the accompanying drawings.

DETAILED DESCRIPTION OF THE EMBODIMENTS

Figure 1A:
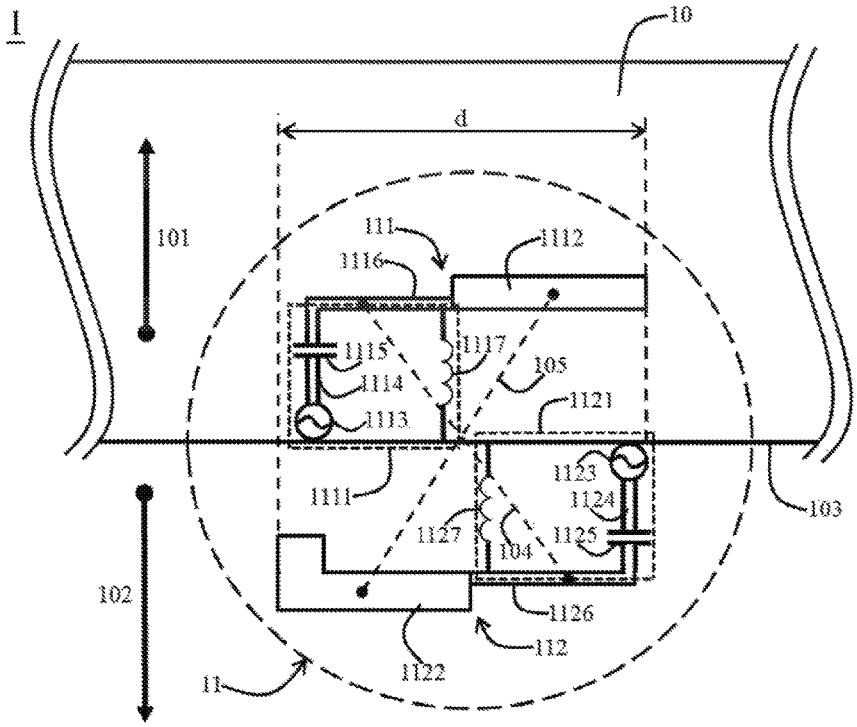
FIG. 1A is a structural diagram of a multi-band multi-antenna array 1 in accordance with an embodiment of the present disclosure.

The present disclosure provides an exemplary embodiment of a multi-band multi-antenna array. The multi-band multi-antenna array includes a ground conductor plane and a dual antenna array. The ground conductor plane separates a first side space and a second side space opposite to the first side space, and includes a first edge. The dual antenna array is at the first edge having a maximum array length extending along the first edge. The dual antenna array may include a first antenna and a second antenna. The first antenna is in the first side space, and may include a first resonant loop and a first radiating conductor line. The first resonant loop is formed by connecting a first signal source, a first feeding conductor line, a first capacitive coupling portion, a first resonant conductor line, a first inductive grounding conductor portion, and the first edge in series. The first radiating conductor line is electrically connected with the first resonant conductor line. The first resonant conductor line is positioned between the first capacitive coupling portion and the first inductive grounding conductor portion. The first resonant loop excites the first antenna to generate a first resonant mode, and the first radiating conductor line excites the first antenna to generate a second resonant mode. The frequencies of the first resonant mode are lower than those of the second resonant mode. The second antenna is in the second side space, and may include a second resonant loop and a second radiating conductor line. The second resonant loop is formed by connecting a second signal source, a second feeding conductor line, a second capacitive coupling portion, a second resonant conductor line, a second inductive grounding conductor portion, and the first edge in series. The second radiating conductor line is electrically connected with the second resonant conductor line. The second resonant conductor line is positioned between the second capacitive coupling portion and the second inductive grounding conductor portion. The second resonant loop excites the second antenna to generate a third resonant mode, and the second radiating conductor line excites the second antenna to generate a fourth resonant mode. The frequencies of the third resonant mode are lower than those of the fourth resonant mode. The connection line of centers of the first resonant conductor line and the second resonant conductor line intersects the connection line of centers of the first radiating conductor line and the second radiating conductor line. The first resonant mode and the third resonant mode cover at least one identical first communication band, while the second resonant mode and the fourth resonant mode cover at least one identical second communication band. The frequency of the first communication band is less than that of the second communication band.

In order to successfully achieve the technical effects of minimization and high level of integration, the multi-band multi-antenna array design architecture proposed by the present disclosure employs the first resonant loop and the second resonant loop for excitation to generate the first resonant mode and the third resonant mode at lower frequency bands, respectively, to cover the lower first communication band operation. The first capacitive coupling portion and the second capacitive coupling portion are configured such that the path lengths of first resonant loop and the second resonant loop are both between 0.15 wavelength and 0.35 wavelength of the lowest operating frequency of the first communication band, thereby achieving the technical effect of minimization. The first capacitive coupling portion (or the second capacitive coupling portion) and the first inductive grounding conductor portion (or the second inductive grounding conductor portion) are capable of forming an equivalent feeding matching circuit of the first radiating conductor line (or the second radiating conductor line) at a higher frequency band, such that the second resonant mode (or the fourth resonant mode) at a higher frequency band can be successfully excited and generated to cover the higher second communication band operation. As a result, multi-band operations could be achieved. Moreover, the equivalent feeding matching circuits of the first radiating conductor line and the second radiating conductor line are configured such that the path lengths of the first radiating conductor line and the second radiating conductor line are effectively reduced, both between 0.06 wavelength and 0.21 wavelength of the lowest operating frequency of the second communication band. The multi-band multi-antenna array according to the present disclosure successfully staggers the first resonant loop and the second resonant loop at two sides of the ground conductor plane without overlapping completely by arranging them such that the connection line of centers of the first resonant conductor line and the second resonant conductor line must intersect the connection line of centers of the first radiating conductor line and the second radiating conductor line, thereby effectively reducing the level of energy coupling between the first resonant mode and the third resonant mode of the lower frequency band, and similarly reducing the level of energy coupling between the second resonant mode and the fourth resonant mode of the higher frequency band. As a result, the maximum array length of the dual antenna array extending along the first edge could be effectively reduced to between 0.1 wavelength and 0.33 wavelength of the lowest operating frequency of the first communication band.

Figure 1B:
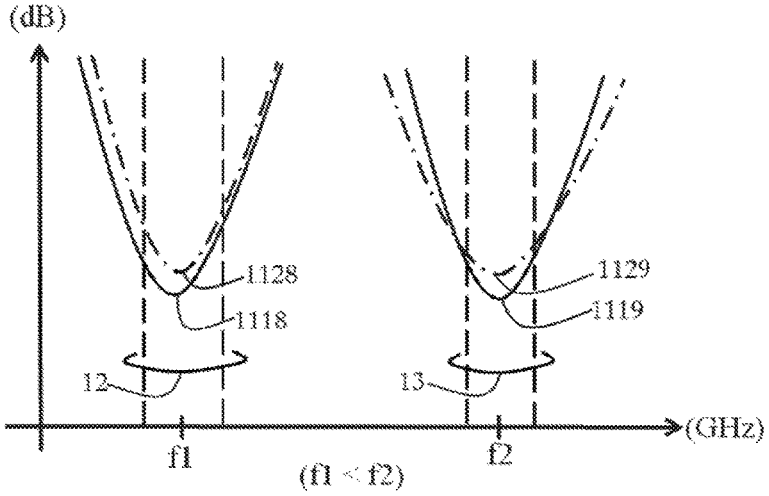
FIG. 1B is a graph depicting the return loss of a dual antenna array 11 of the multi-band multi-antenna array 1 in accordance with an embodiment of the present disclosure.

FIG. 1A is a structural diagram of a multi-band multi-antenna array 1 in accordance with an embodiment of the present disclosure. FIG. 1B is a graph depicting the return loss of a dual antenna array 11 of the multi-band multi-antenna array 1 in accordance with an embodiment of the present disclosure. As shown in FIGS. 1A and 1B, the multi-band multi-antenna array 1 includes a ground conductor plane 10 and the dual antenna array 11. The ground conductor plane 10 separates a first side space 101 and a second side space 102 opposite to the first side space 101. The ground conductor plane 10 has a first edge 103. The dual antenna array 11 is at the first edge 103. The dual antenna array 11 has a maximum array length d extending along the first edge 103. The dual antenna array 11 includes a first antenna 111 and a second antenna 112. The first antenna 111 is in the first side space 101 and includes a first resonant loop 1111 and a first radiating conductor line 1112. The first resonant loop 1111 is formed by connecting a first signal source 1113, a first feeding conductor line 1114, a first capacitive coupling portion 1115, a first resonant conductor line 1116, a first inductive grounding conductor portion 1117, and the first edge 103 in series. The first radiating conductor line 1112 is electrically connected with the first resonant conductor line 1116, and the first resonant conductor line 1116 is connected between the first capacitive coupling portion 1115 and the first inductive grounding conductor portion 1117. The first capacitive coupling portion 1115 could be a chip capacitive element, or the first capacitive coupling portion 1115 could be formed by mutual coupling of the first feeding conductor line 1114 and the first resonant conductor line 1116. The first inductive grounding conductor portion 1117 could be a meandering conductor line segment, or a conductor line segment including a chip inductive element. The path length of the first resonant conductor line 1116 is between 0.33 times and 0.68 times the sum of the path lengths of the first resonant conductor line 1116 and the first radiating conductor line 1112. The first resonant loop 1111 excites the first antenna 111 to generate a first resonant mode 1118 (as shown in FIG. 1B), the first radiating conductor line 1112 excites the first antenna 111 to generate a second resonant mode 1119 (as shown in FIG. 1B), and the frequencies of the first resonant mode 1118 are lower than the frequencies of the second resonant mode 1119. The second antenna 112 is in the second side space 101, and includes a second resonant loop 1121 and a second radiating conductor line 1122. The second resonant loop 1121 is formed by connecting a second signal source 1123, a second feeding conductor line 1124, a second capacitive coupling portion 1125, a second resonant conductor line 1126, a second inductive grounding conductor portion 1127, and the first edge 103 in series. The second radiating conductor line 1122 is electrically connected with the second resonant conductor line 1126, and the second resonant conductor line 1126 is connected between the second capacitive coupling portion 1125 and the second inductive grounding conductor portion 1127. The second capacitive coupling portion 1125 could be a chip capacitive element, or the second capacitive coupling portion 1125 could be formed by mutual coupling of the second feeding conductor line 1124 and the second resonant conductor line 1126. The second inductive grounding conductor portion 1127 could be a meandering conductor line segment, or a conductor line segment including a chip inductive element. The path length of the second resonant conductor line 1126 is between 0.33 times and 0.68 times the sum of the path lengths of the second resonant conductor line 1126 and the second radiating conductor line 1122. The second resonant loop 1121 excites the second antenna 112 to generate a third resonant mode 1128 (as shown in FIG. 1B), the second radiating conductor line 1122 excites the second antenna 112 to generate a fourth resonant mode 1129 (as shown in FIG. 1B), and the frequencies of the third resonant mode 1128 are lower than the frequencies of the fourth resonant mode 1129. The connection line 104 of centers of the first resonant conductor line 1116 and the second resonant conductor line 1126 must intersect the connection line 105 of centers of the first radiating conductor line 1112 and the second radiating conductor line 1122. The first resonant mode 1118 and the third resonant mode 1128 cover at least one identical first communication band 12 (as shown in FIG. 1B), while the second resonant mode 1119 and the fourth resonant mode 1129 cover at least one identical second communication band 13 (as shown in FIG. 1B). The frequencies of the first communication band 12 are lower than those of the second communication band 13. The maximum array length d of the dual antenna array 11 extending along the first edge 103 is between 0.1 wavelength and 0.33 wavelength of the lowest operating frequency of the first communication band 12. The path lengths of the first resonant loop 1111 and the second resonant loop 1121 are both between 0.15 wavelength and 0.35 wavelength of the lowest operating frequency of the first communication band 12. The path lengths of the first radiating conductor line 1112 and the second radiating conductor line 1122 are both between 0.06 wavelength and 0.21 wavelength of the lowest operating frequency of the second communication band 13. The first signal source 1113 and the second signal source 1123 could be radio frequency (RF) circuit modules, RF IC chips, RF circuit switches, RF filter circuits, RF duplexer circuits, RF transmission line circuits or RF capacitor, inductor, or resistor-matching circuits.

In order to successfully achieve the technical effects of compact and highly integration, the multi-band multi-antenna array 1 proposed by the present disclosure designs and applies the first resonant loop 1111 and the second resonant loop 1121 for excitation to generate the first resonant mode 1118 and the third resonant mode 1128 at lower frequency bands, respectively, to cover the lower first communication band 12 (as shown in FIG. 1B) operations. The first capacitive coupling portion 1115 and the second capacitive coupling portion 1125 are configured such that the path lengths of first resonant loop 1111 and the second resonant loop 1121 are both between 0.15 wavelength and 0.35 wavelength of the lowest operating frequency of the first communication band 12, thereby achieving the technical effect of minimization. The first capacitive coupling portion 1115 (or the second capacitive coupling portion 1125) and the first inductive grounding conductor portion 1117 (or the second inductive grounding conductor portion 1127) are capable of forming an equivalent feeding matching circuit of the first radiating conductor line 1112 (or the second radiating conductor line 1122) at a higher frequency band, such that the second resonant mode 1119 (or the fourth resonant mode 1129) at a higher frequency band could be successfully excited and generated to cover the higher second communication band 13 (as shown in FIG. 1B) operations. As a result, multi-band operations could be achieved. Moreover, the equivalent feeding matching circuits of the first radiating conductor line 1112 and the second radiating conductor line 1122 are configured such that the path lengths of the first radiating conductor line 1112 and the second radiating conductor line 1122 are effectively reduced, both between 0.06 wavelength and 0.21 wavelength of the lowest operating frequency of the second communication band 13. The multi-band multi-antenna array according to the present disclosure successfully staggers the first resonant loop 1111 and the second resonant loop 1121 at two sides of the ground conductor plane 10 without overlapping completely by arranging them such that the connection line 104 of centers of the first resonant conductor line 1116 and the second resonant conductor line 1126 must intersect the connection line 105 of centers of the first radiating conductor line 1112 and the second radiating conductor line 1122, thereby effectively reducing the level of energy coupling between the first resonant mode 1118 and the third resonant mode 1128 at the lower frequency band, and similarly reducing the level of energy coupling between the second resonant mode 1119 and the fourth resonant mode 1129 at the higher frequency band. As a result, the maximum array length d of the dual antenna array 11 extending along the first edge 103 could be effectively reduced to between 0.1 wavelength and 0.33 wavelength of the lowest operating frequency of the first communication band 12.

Figure 2A:
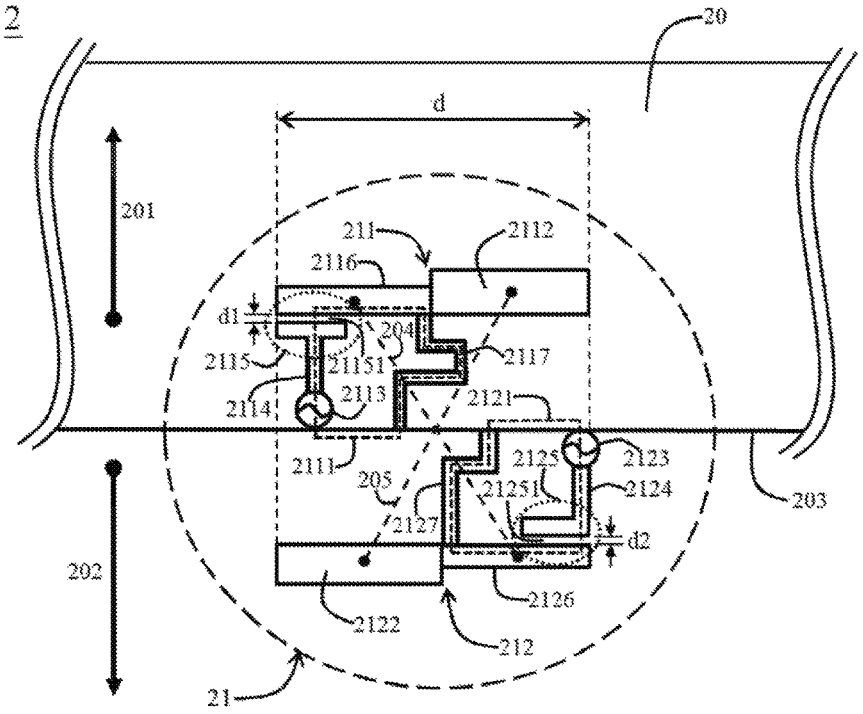
FIG. 2A is a structural diagram of a multi-band multi-antenna array 2 in accordance with an embodiment of the present disclosure.
Figure 2B:
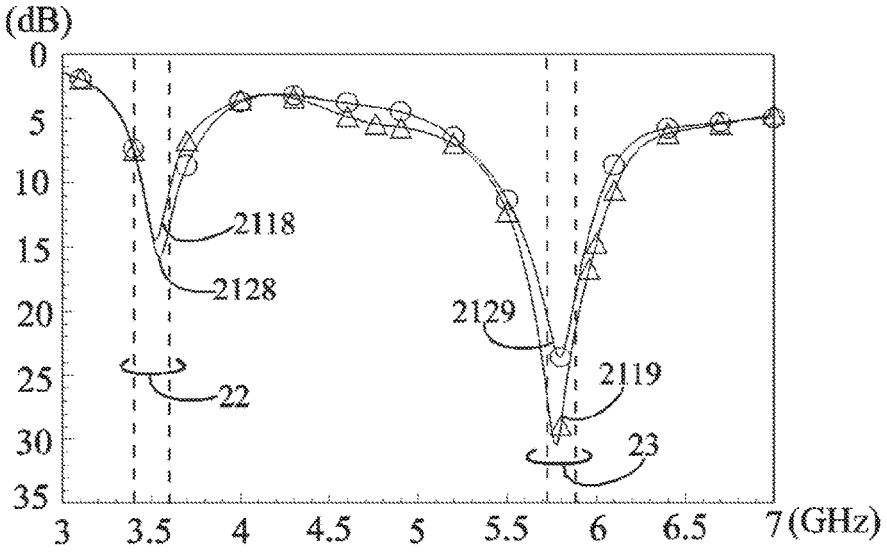
FIG. 2B is a graph depicting the return loss of a dual antenna array 21 of the multi-band multi-antenna array 2 in accordance with an embodiment of the present disclosure.

FIG. 2A is a structural diagram of a multi-band multi-antenna array 2 in accordance with an embodiment of the present disclosure. FIG. 2B is a graph depicting the return loss of a dual antenna array 21 of the multi-band multi-antenna array 2 in accordance with an embodiment of the present disclosure. As shown in FIGS. 2A and 2B, the multi-band multi-antenna array 2 includes a ground conductor plane 20 and the dual antenna array 21. The ground conductor plane 20 separates a first side space 201 and a second side space 202 opposite to the first side space 201. The ground conductor plane 20 has a first edge 203. The dual antenna array 21 is at the first edge 203. The dual antenna array 21 has a maximum array length d extending along the first edge 203. The dual antenna array 21 includes a first antenna 211 and a second antenna 212. The first antenna 211 is in the first side space 201 and includes a first resonant loop 2111 and a first radiating conductor line 2112. The first resonant loop 2111 is formed by connecting a first signal source 2113, a first feeding conductor line 2114, a first capacitive coupling portion 2115, a first resonant conductor line 2116, a first inductive grounding conductor portion 2117, and the first edge 203 in series. The first radiating conductor line 2112 is electrically connected with the first resonant conductor line 2116, and the first resonant conductor line 2116 is connected between the first capacitive coupling portion 2115 and the first inductive grounding conductor portion 2117. The first capacitive coupling portion 2115 is formed as a result of mutual coupling between the first feeding conductor line 2114 and the first resonant conductor line 2116, and there is a first coupling slit 21151 between the first feeding conductor line 2114 and the first resonant conductor line 2116. The first inductive grounding conductor portion 2117 is a meandering conductor line segment. The path length of the first resonant conductor line 2116 is between 0.33 times and 0.68 times the sum of the path lengths of the first resonant conductor line 2116 and the first radiating conductor line 2112. The first resonant loop 2111 is configured to excite the first antenna 211 generating a first resonant mode 2118 (as shown in FIG. 2B), the first radiating conductor line 2112 is configured to excite the first antenna 211 generating a second resonant mode 2119 (as shown in FIG. 2B), and the frequencies of the first resonant mode 2118 are lower than the frequencies of the second resonant mode 2119. The second antenna 212 is in the second side space 202, and includes a second resonant loop 2121 and a second radiating conductor line 2122. The second resonant loop 2121 is formed by connecting a second signal source 2123, a second feeding conductor line 2124, a second capacitive coupling portion 2125, a second resonant conductor line 2126, a second inductive grounding conductor portion 2127, and the first edge 203 in series. The second radiating conductor line 2122 is electrically connected with the second resonant conductor line 2126, and the second resonant conductor line 2126 is connected between the second capacitive coupling portion 2125 and the second inductive grounding conductor portion 2127. The second capacitive coupling portion 2125 is formed as a result of mutual coupling of the second feeding conductor line 2124 and the second resonant conductor line 2126, and there is a second coupling slit 21251 between the second feeding conductor line 2124 and the second resonant conductor line 2126. The second inductive grounding conductor portion 2127 is a meandering conductor line segment. The path length of the second resonant conductor line 2126 is between 0.33 times and 0.68 times the sum of the path lengths of the second resonant conductor line 2126 and the second radiating conductor line 2122. The second resonant loop 2121 is configured to excite the second antenna 212 generating a third resonant mode 2128 (as shown in FIG. 2B), the second radiating conductor line 2122 is configured to excite the second antenna 212 generating a fourth resonant mode 2129 (as shown in FIG. 2B), and the frequencies of the third resonant mode 2128 are lower than the frequencies of the fourth resonant mode 2129. The connection line 204 of centers of the first resonant conductor line 2116 and the second resonant conductor line 2126 must intersect the connection line 205 of centers of the first radiating conductor line 2112 and the second radiating conductor line 2122. The first resonant mode 2118 and the third resonant mode 2128 cover at least one identical first communication band 22 (as shown in FIG. 2B), while the second resonant mode 2119 and the fourth resonant mode 2129 cover at least one identical second communication band 23 (as shown in FIG. 2B). The frequencies of the first communication band 22 are lower than those of the second communication band 23. The maximum array length d of the dual antenna array 21 extending along the first edge 203 is between 0.1 wavelength and 0.33 wavelength of the lowest operating frequency of the first communication band 22. The gap d1 of the first coupling slit 21151 is between 0.001 wavelength and 0.039 wavelength of the lowest operating frequency of the first communication band 22. The gap d2 of the second coupling slit 21251 is also between 0.001 wavelength and 0.039 wavelength of the lowest operating frequency of the first communication band 22. The path lengths of the first resonant loop 2111 and the second resonant loop 2121 are both between 0.15 wavelength and 0.35 wavelength of the lowest operating frequency of the first communication band 22. The path lengths of the first radiating conductor line 2112 and the second radiating conductor line 2122 are both between 0.06 wavelength and 0.21 wavelength of the lowest operating frequency of the second communication band 23. The first signal source 2113 and the second signal source 2123 can be RF circuit modules, RF IC chips, RF circuit switches, RF filter circuits, RF duplexer circuits, RF transmission line circuits or RF capacitor, inductor, or resistor-matching circuits.

In order to successfully achieve the technical effects of compact and highly integration, the multi-band multi-antenna array 2 proposed by the present disclosure designs and uses the first resonant loop 2111 and the second resonant loop 2121 for excitation to generate the first resonant mode 2118 and the third resonant mode 2128 of lower frequency bands, respectively, to cover the lower first communication band 22 (as shown in FIG. 2B) operations. The first capacitive coupling portion 2115 and the second capacitive coupling portion 2125 are configured such that the path lengths of first resonant loop 2111 and the second resonant loop 2121 are both between 0.15 wavelength and 0.35 wavelength of the lowest operating frequency of the first communication band 22, thereby achieving the technical effect of minimization. The first capacitive coupling portion 2115 (or the second capacitive coupling portion 2125) and the first inductive grounding conductor portion 2117 (or the second inductive grounding conductor portion 2127) are capable of forming an equivalent feeding matching circuit of the first radiating conductor line 2112 (or the second radiating conductor line 2122) at a higher frequency band, such that the second resonant mode 2119 (or the fourth resonant mode 2129) at a higher frequency band can be successfully excited and generated to cover the higher second communication band 23 (as shown in FIG. 2B) operations. As a result, multi-band operations can be achieved. Moreover, the equivalent feeding matching circuits of the first radiating conductor line 2112 and the second radiating conductor line 2122 are configured such that the path lengths of the first radiating conductor line 2112 and the second radiating conductor line 2122 are effectively reduced, both between 0.06 wavelength and 0.21 wavelength of the lowest operating frequency of the second communication band 23. The multi-band multi-antenna array according to the present disclosure successfully staggers the first resonant loop 2111 and the second resonant loop 2121 at two sides of the ground conductor plane 20 without overlapping completely by arranging them such that the connection line 204 of centers of the first resonant conductor line 2116 and the second resonant conductor line 2126 must intersect the connection line 205 of centers of the first radiating conductor line 2112 and the second radiating conductor line 2122, thereby effectively reducing the level of energy coupling between the first resonant mode 2118 and the third resonant mode 2128 of the lower frequency band. Similarly, the multi-band multi-antenna array according to the present disclosure successfully staggers the first radiating conductor line 2112 and the second radiating conductor line 2122 at two sides of the ground conductor plane 20 without overlapping completely, thereby effectively reducing the level of energy coupling between the second resonant mode 2119 and the fourth resonant mode 2129 of the higher frequency band. As a result, the maximum array length d of the dual antenna array 21 extending along the first edge 203 can be effectively reduced to between 0.1 wavelength and 0.33 wavelength of the lowest operating frequency of the first communication band 22.

FIG. 2B is a graph depicting the return loss of the dual antenna array 21 of the multi-band multi-antenna array 2 in accordance with an embodiment of the present disclosure. The following dimensions were used for the experiments: the length of the first edge 203 of the ground conductor plane 20 being about 160 mm; the width of the ground conductor plane 20 being about 80 mm; the maximum arrange length d of the dual antenna array 21 extending along the first edge 203 being about 15.9 mm; the path length of the first resonant loop 2111 being about 22.9 mm; the path length of the second resonant loop 2121 being about 22.3 mm; the path length of the first radiating conductor line 2112 being about 8.5 mm; the path length of the second radiating conductor line 2122 being about 8.2 mm; the path length of the first resonant conductor line 2116 being about 7.4 mm; the path length of the second resonant conductor line 2126 being about 7.7 mm; the path length of the first inductive grounding conductor portion 2117 being about 4.6 mm; the path length of the second inductive grounding conductor portion 2127 being about 4.8 mm; the gap d1 of the first coupling slit 21151 being about 0.36 mm; and the gap d2 of the second coupling slit 21251 being about 0.42 mm. As shown in FIG. 2B, the first resonant loop 2111 excites the first antenna 211 to generate the first resonant mode 2118; the first radiating conductor line 2112 excites the first antenna 211 to generate the second resonant mode 2119; and the frequencies of the first resonant mode 2118 are lower than those of the second resonant mode 2119. The second resonant loop 2121 excites the second antenna 212 to generate the third resonant mode 2128; the second radiating conductor line 2122 excites the second antenna 212 to generate the fourth resonant mode 2129; and the frequencies of the third resonant mode 2128 are lower than those of the fourth resonant mode 2129. In this embodiment, the first resonant mode 2118 and the third resonant mode 2128 cover the same first communication band 22 (3400 MHz-3600 MHz), the second resonant mode 2119 and the fourth resonant mode 2129 cover the same second communication band 23 (5725 MHz-5875 MHz), and the frequencies of the first communication band 22 are lower than those of the second communication band 23. The lowest operating frequency of the first communication band 22 is approximately 3400 MHz, while the lowest operating frequency of the first communication band 23 is approximately 5725 MHz.

Figure 2C:
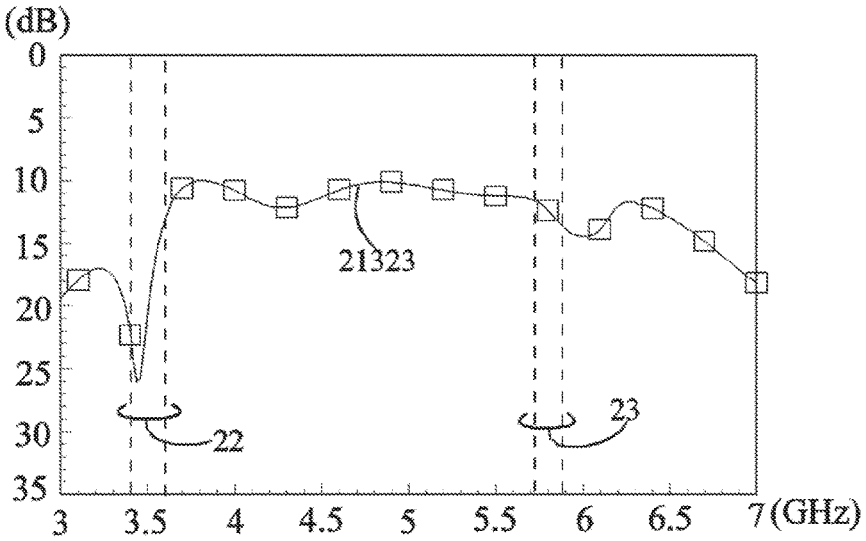
FIG. 2C is a graph depicting an isolation curve of the dual antenna array 21 of the multi-band multi-antenna array 2 in accordance with an embodiment of the present disclosure.
Figure 2D:
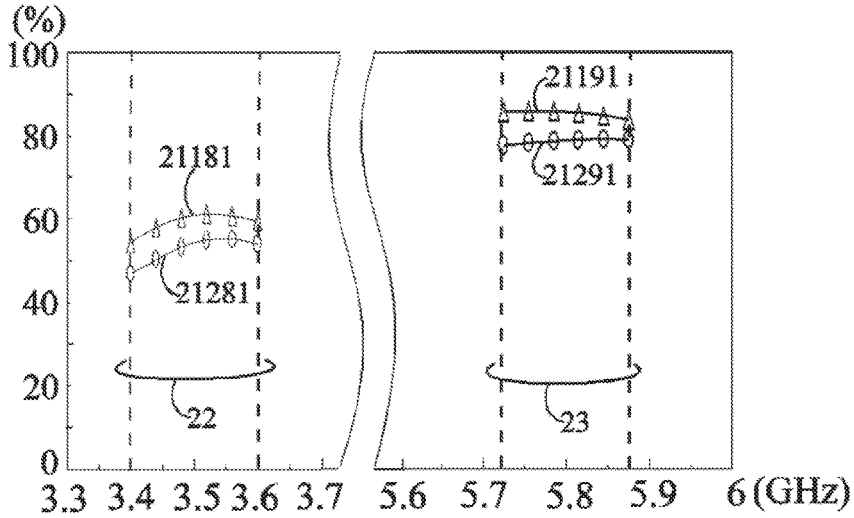
FIG. 2D is a graph depicting radiation efficiency curves of the dual antenna array 21 of the multi-band multi-antenna array 2 in accordance with an embodiment of the present disclosure.
Figure 2E:
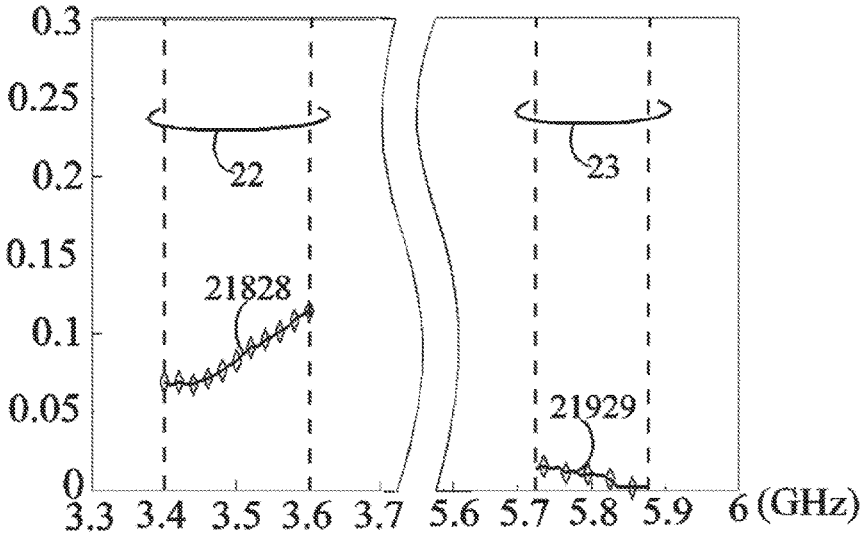
FIG. 2E is a graph depicting envelop correlation coefficient (ECC) curves of the dual antenna array 21 of the multi-band multi-antenna array 2 in accordance with an embodiment of the present disclosure.

FIG. 2C is a graph depicting an isolation curve of the dual antenna array 21 of the multi-band multi-antenna array 2 in accordance with an embodiment of the present disclosure. The isolation curve between the first antenna 211 and the second antenna 212 is denoted as 21323. As shown in FIG. 2C, the isolation curve 21323 of the dual antenna array 21 is better than 10 dB within the first communication band 22 and is also better than 10 dB within the second communication band 23, thereby demonstrating good isolation performance. FIG. 2D is a graph depicting radiation efficiency curves of the dual antenna array 21 of the multi-band multi-antenna array 2 in accordance with an embodiment of the present disclosure. The radiation efficiency curves of the first antenna 211 within the first communication band 22 and the second communication band 23 are denoted as 21181 and 21191, respectively. The radiation efficiency curves of the second antenna 212 within the first communication band 22 and the second communication band 23 are denoted as 21281 and 21291, respectively. As shown in FIG. 2D, the radiation efficiency curve 21181 of the first antenna 211 within the first communication band 22 is above 50%, while the radiation efficiency curve 21191 thereof within the second communication band 23 is above 80%; and the radiation efficiency curve 21281 of the second antenna 212 within the first communication band 22 is above 45%, while the radiation efficiency curve 21291 thereof within the second communication band 23 is above 75%. FIG. 2E is a graph depicting envelop correlation coefficient (ECC) curves of the dual antenna array 21 of the multi-band multi-antenna array 2 in accordance with an embodiment of the present disclosure. The ECC curve of the first antenna 211 and the second antenna 212 within the first communication band 22 is denoted as 21828, and the ECC curve of the same within the second communication band 23 is denoted as 21929. As shown in FIG. 2E, the ECC curve of the dual antenna array 21 is lower than 0.15 within the first communication band 22 and lower than 0.05 within the second communication band 23.

The communication frequency band operations and experimental data included in FIGS. 2B, 2C, 2D and 2E are merely used to demonstrate the technical effects of the multi-band multi-antenna array 2 in accordance with an embodiment of the present disclosure shown in FIG. 2A, and are not intended to limit the communication frequency band operations, applications and specifications that could be covered by the multi-band multi-antenna array 2 according to the present disclosure in practical implementations. The multi-band multi-antenna array 2 according to the present disclosure could be designed to cover the system frequency band operations of Wireless Wide Area Network (WWAN), Multi-Input Multi-Output (MIMO) System; Long Term Evolution (LTE); Pattern Switchable Antenna System; Wireless Personal Network (WLPN); Wireless Local Area Network (WLAN); Beam-Forming Antenna System, Near Field Communication (NFC); Digital Television Broadcasting System (DTV) or Global Positioning System (GPS). A multi-antenna communication device could be realized with a single dual antenna array 21 or a plurality of dual antenna arrays 21 of the multi-band multi-antenna array 2 according to the present disclosure. The multi-antenna communication device could be a mobile communication device, a wireless communication device, a mobile computing device, a computer system, a telecommunications equipment, a network apparatus, or a computer or network peripheral.

Figure 3A:
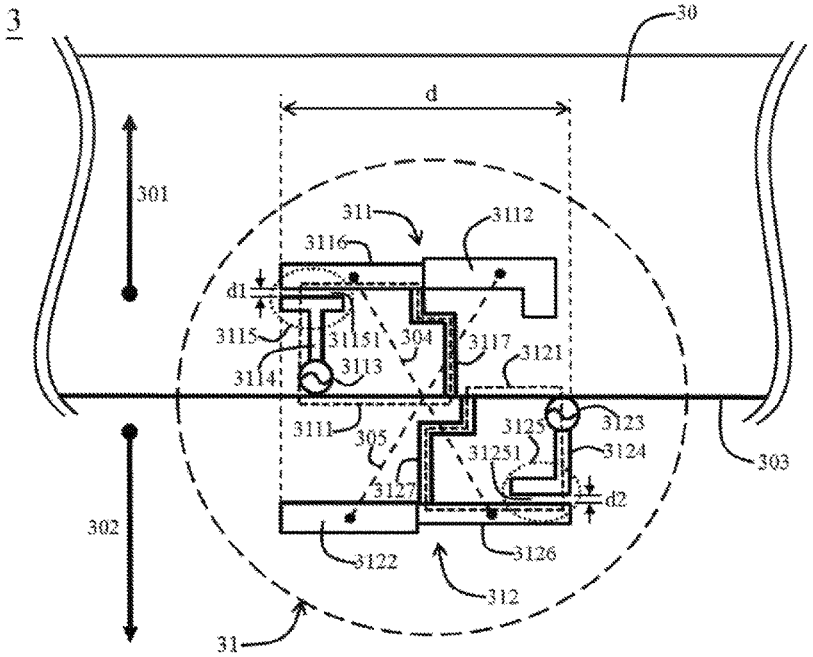
FIG. 3A is a structural diagram of a multi-band multi-antenna array 3 in accordance with an embodiment of the present disclosure.
Figure 3B:
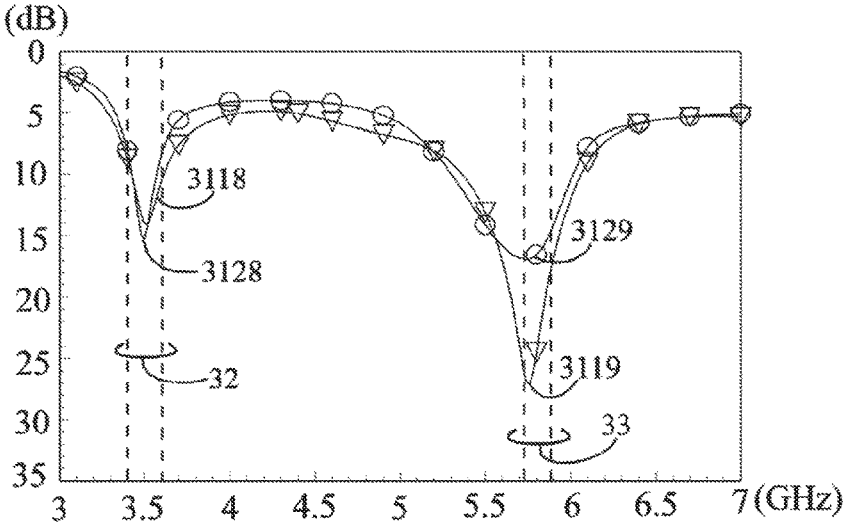
FIG. 3B is a graph depicting the return loss of a dual antenna array 31 of the multi-band multi-antenna array 3 in accordance with an embodiment of the present disclosure.

FIG. 3A is a structural diagram of a multi-band multi-antenna array 3 in accordance with an embodiment of the present disclosure. FIG. 3B is a graph depicting the return loss of a dual antenna array 31 of the multi-band multi-antenna array 3 in accordance with an embodiment of the present disclosure. As shown in FIGS. 3A and 3B, the multi-band multi-antenna array 3 includes a ground conductor plane 30 and the dual antenna array 31. The ground conductor plane 30 separates a first side space 301 and a second side space 302 opposite to the first side space 301. The ground conductor plane 30 has a first edge 303. The dual antenna array 31 is at the first edge 303. The dual antenna array 31 has a maximum array length d extending along the first edge 303. The dual antenna array 31 includes a first antenna 311 and a second antenna 312. The first antenna 311 is in the first side space 301 and includes a first resonant loop 3111 and a first radiating conductor line 3112. The first resonant loop 3111 is formed by connecting a first signal source 3113, a first feeding conductor line 3114, a first capacitive coupling portion 3115, a first resonant conductor line 3116, a first inductive grounding conductor portion 3117, and the first edge 303 in series. The first radiating conductor line 3112 is electrically connected with the first resonant conductor line 3116, and the first resonant conductor line 3116 is positioned between the first capacitive coupling portion 3115 and the first inductive grounding conductor portion 3117. The first capacitive coupling portion 3115 is formed as a result of mutual coupling between the first feeding conductor line 3114 and the first resonant conductor line 3116, and there is a first coupling slit 31151 between the first feeding conductor line 3114 and the first resonant conductor line 3116. The first inductive grounding conductor portion 3117 is a meandering conductor line segment. The path length of the first resonant conductor line 3116 is between 0.33 times and 0.68 times the sum of the path lengths of the first resonant conductor line 3116 and the first radiating conductor line 3112. The first resonant loop 3111 is configured to excite the first antenna 311 generating a first resonant mode 3118 (as shown in FIG. 3B), the first radiating conductor line 3112 is configured to excite the first antenna 311 generating a second resonant mode 3119 (as shown in FIG. 3B), and the frequencies of the first resonant mode 3118 are lower than the frequencies of the second resonant mode 3119. The second antenna 312 is in the second side space 302, and includes a second resonant loop 3121 and a second radiating conductor line 3122. The second resonant loop 3121 is formed by connecting a second signal source 3123, a second feeding conductor line 3124, a second capacitive coupling portion 3125, a second resonant conductor line 3126, a second inductive grounding conductor portion 3127, and the first edge 303 in series. The second radiating conductor line 3122 is electrically connected with the second resonant conductor line 3126, and the second resonant conductor line 3126 is positioned between the second capacitive coupling portion 3125 and the second inductive grounding conductor portion 3127. The second capacitive coupling portion 3125 is formed as a result of mutual coupling of the second feeding conductor line 3124 and the second resonant conductor line 3126, and there is a second coupling slit 31251 between the second feeding conductor line 3124 and the second resonant conductor line 3126. The second inductive grounding conductor portion 3127 is a meandering conductor line segment. The path length of the second resonant conductor line 3126 is between 0.33 times and 0.68 times the sum of the path lengths of the second resonant conductor line 3126 and the second radiating conductor line 3122. The second resonant loop 3121 is configured to excite the second antenna 312 generating a third resonant mode 3128 (as shown in FIG. 3B), the second radiating conductor line 3122 is configured to excite the second antenna 312 generating a fourth resonant mode 3129 (as shown in FIG. 3B), and the frequencies of the third resonant mode 3128 are lower than the frequencies of the fourth resonant mode 3129. The connection line 304 of centers of the first resonant conductor line 3116 and the second resonant conductor line 3126 must intersect the connection line 305 of centers of the first radiating conductor line 3112 and the second radiating conductor line 3122. The first resonant mode 3118 and the third resonant mode 3128 cover at least one identical first communication band 32 (as shown in FIG. 3B), while the second resonant mode 3119 and the fourth resonant mode 3129 cover at least one identical second communication band 33 (as shown in FIG. 3B). The frequencies of the first communication band 32 are lower than those of the second communication band 33. The maximum array length d of the dual antenna array 31 extending along the first edge 303 is between 0.1 wavelength and 0.33 wavelength of the lowest operating frequency of the first communication band 32. The gap d1 of the first coupling slit 31151 is between 0.001 wavelength and 0.039 wavelength of the lowest operating frequency of the first communication band 32. The gap d2 of the second coupling slit 31251 is also between 0.001 wavelength and 0.039 wavelength of the lowest operating frequency of the first communication band 32. The path lengths of the first resonant loop 3111 and the second resonant loop 3121 are both between 0.15 wavelength and 0.35 wavelength of the lowest operating frequency of the first communication band 32. The path lengths of the first radiating conductor line 3112 and the second radiating conductor line 3122 are both between 0.06 wavelength and 0.21 wavelength of the lowest operating frequency of the second communication band 33. The first signal source 3113 and the second signal source 3123 can be RF circuit modules, RF IC chips, RF circuit switches, RF filter circuits, RF duplexer circuits, RF transmission line circuits or RF capacitor, inductor, or resistor-matching circuits.

Although the first radiating conductor line 3112 of the dual antenna array 31 is different in shape from the first radiating conductor line 2112 in the dual antenna array 21, and the first inductive grounding conductor portion 3117 of the dual antenna array 31 is also different in shape from the first inductive grounding conductor portion 2117 in the dual antenna array 21, the dual antenna array 31 of this embodiment similarly configures the first resonant loop 3111 and the second resonant loop 3121 for excitation to generate the first resonant mode 3118 and the third resonant mode 3128 at lower frequency bands, respectively, to successfully cover the lower first communication band 32 (as shown in FIG. 3B) operations. Also, the first capacitive coupling portion 3115 and the second capacitive coupling portion 3125 are configured such that the path lengths of first resonant loop 3111 and the second resonant loop 3121 are both between 0.15 wavelength and 0.35 wavelength of the lowest operating frequency of the first communication band 32, thereby achieving the technical effect with highly integration characteristics. The first capacitive coupling portion 3115 (or the second capacitive coupling portion 3125) and the first inductive grounding conductor portion 3117 (or the second inductive grounding conductor portion 3127) of this embodiment are similarly capable of forming an equivalent feeding matching circuit of the first radiating conductor line 3112 (or the second radiating conductor line 3122) at a higher frequency band, such that the second resonant mode 3119 (or the fourth resonant mode 3129) at a higher frequency band can be successfully excited and generated to cover the higher second communication band 33 (as shown in FIG. 3B) operations. As a result, multi-band operations can be achieved. Moreover, the equivalent feeding matching circuits of the first radiating conductor line 3112 and the second radiating conductor line 3122 are configured such that the path lengths of the first radiating conductor line 3112 and the second radiating conductor line 3122 are effectively reduced, both between 0.06 wavelength and 0.21 wavelength of the lowest operating frequency of the second communication band 33. The multi-band multi-antenna array 3 according to the present disclosure successfully staggers the first resonant loop 3111 and the second resonant loop 3121 at two sides of the ground conductor plane 30 without overlapping completely by similarly arranging them such that the connection line 304 of centers of the first resonant conductor line 3116 and the second resonant conductor line 3126 must intersect the connection line 305 of centers of the first radiating conductor line 3112 and the second radiating conductor line 3122, thereby effectively reducing the level of energy coupling between the first resonant mode 3118 and the third resonant mode 3128 at the lower frequency band. Similarly, the multi-band multi-antenna array 3 according to the present disclosure successfully staggers the first radiating conductor line 3112 and the second radiating conductor line 3122 at two sides of the ground conductor plane 30 without overlapping completely, thereby effectively reducing the level of energy coupling between the second resonant mode 3119 and the fourth resonant mode 3129 at the higher frequency band. As a result, the maximum array length d of the dual antenna array 31 extending along the first edge 303 can be effectively reduced to between 0.1 wavelength and 0.33 wavelength of the lowest operating frequency of the first communication band 32. Thus, the multi-band multi-antenna array 3 of this embodiment is capable of achieving the technical effects of compact and highly integration similar to those achieved by the multi-band multi-antenna array 2 in the previous embodiment.

FIG. 3B is a graph depicting the return loss of the dual antenna array 31 of the multi-band multi-antenna array 3 in accordance with an embodiment of the present disclosure. The following dimensions were used for the experiments: the length of the first edge 303 of the ground conductor plane 30 being about 168 mm; the width of the ground conductor plane 30 being about 83 mm; the maximum arrange length d of the dual antenna array 31 extending along the first edge 303 being about 16.8 mm; the path length of the first resonant loop 3111 being about 22.6 mm; the path length of the second resonant loop 3121 being about 22.7 mm; the path length of the first radiating conductor line 3112 being about 8.2 mm; the path length of the second radiating conductor line 3122 being about 8.0 mm; the path length of the first resonant conductor line 3116 being about 7.3 mm; the path length of the second resonant conductor line 3126 being about 8.8 mm; the path length of the first inductive grounding conductor portion 3117 being about 4.05 mm; the path length of the second inductive grounding conductor portion 3127 being about 4.8 mm; the gap d1 of the first coupling slit 21151 being about 0.33 mm; and the gap d2 of the second coupling slit 31251 being about 0.39 mm. As shown in FIG. 3B, the first resonant loop 3111 excites the first antenna 311 to generate the first resonant mode 3118; the first radiating conductor line 3112 excites the first antenna 311 to generate the second resonant mode 3119; and the frequencies of the first resonant mode 3118 are lower than those of the second resonant mode 3119. The second resonant loop 3121 excites the second antenna 312 to generate the third resonant mode 3128; the second radiating conductor line 3122 excites the second antenna 312 to generate the fourth resonant mode 3129; and the frequencies of the third resonant mode 3128 are lower than those of the fourth resonant mode 3129. In this embodiment, the first resonant mode 3118 and the third resonant mode 3128 cover the same first communication band 32 (3400 MHz-3600 MHz), the second resonant mode 3119 and the fourth resonant mode 3129 cover the same second communication band 33 (5725 MHz-5875 MHz), and the frequencies of the first communication band 32 are lower than those of the second communication band 33. The lowest operating frequency of the first communication band 32 is approximately 3400 MHz, while the lowest operating frequency of the first communication band 33 is approximately 5725 MHz.

Figure 3C:
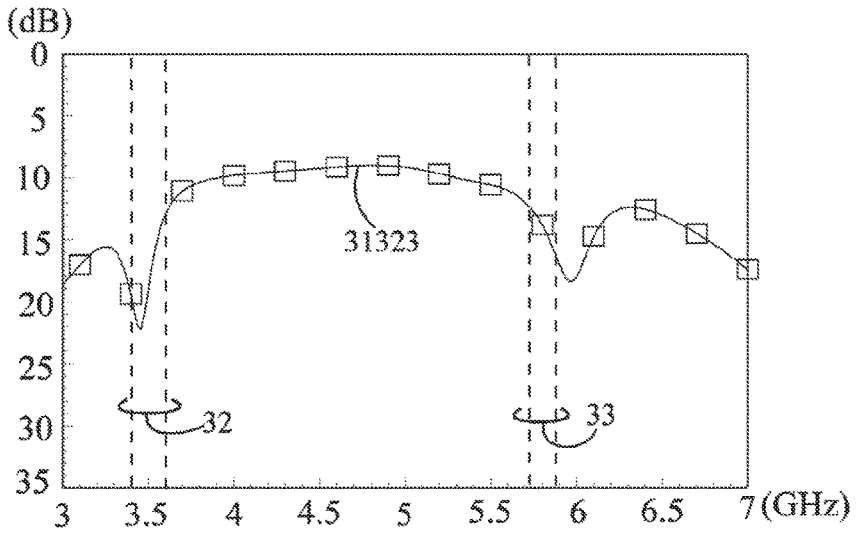
FIG. 3C is a graph depicting an isolation curve of the dual antenna array 31 of the multi-band multi-antenna array 3 in accordance with an embodiment of the present disclosure.
Figure 3D:
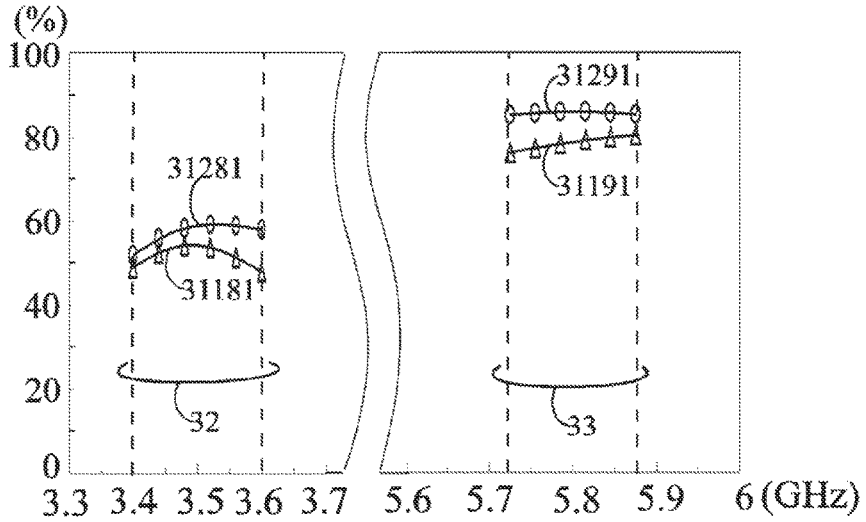
FIG. 3D is a graph depicting radiation efficiency curves of the dual antenna array 31 of the multi-band multi-antenna array 3 in accordance with an embodiment of the present disclosure.
Figure 3E:
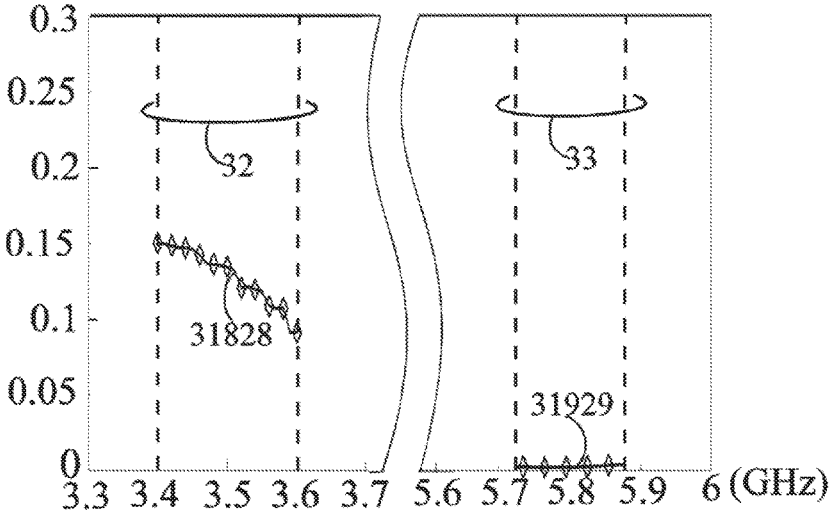
FIG. 3E is a graph depicting envelop correlation coefficient (ECC) curves of the dual antenna array 31 of the multi-band multi-antenna array 3 in accordance with an embodiment of the present disclosure.

FIG. 3C is a graph depicting an isolation curve of the dual antenna array 31 of the multi-band multi-antenna array 3 in accordance with an embodiment of the present disclosure. The isolation curve between the first antenna 311 and the second antenna 312 is denoted as 31323. As shown in FIG. 3C, the isolation curve 31323 of the dual antenna array 31 is higher than 12 dB within the first communication band 32 and is also higher than 12 dB within the second communication band 33, thereby demonstrating good isolation performance. FIG. 3D is a graph depicting radiation efficiency curves of the dual antenna array 31 of the multi-band multi-antenna array 3 in accordance with an embodiment of the present disclosure. The radiation efficiency curves of the first antenna 311 within the first communication band 32 and the second communication band 33 are denoted as 31181 and 31191, respectively. The radiation efficiency curves of the second antenna 312 within the first communication band 32 and the second communication band 33 are denoted as 31281 and 31291, respectively. As shown in FIG. 3D, the radiation efficiency curve 31181 of the first antenna 311 within the first communication band 32 is above 45%, while the radiation efficiency curve 31191 thereof within the second communication band 33 is above 70%; and the radiation efficiency curve 31281 of the second antenna 312 within the first communication band 32 is above 50%, while the radiation efficiency curve 31291 thereof within the second communication band 33 is above 80%. FIG. 3E is a graph depicting envelop correlation coefficient (ECC) curves of the dual antenna array 31 of the multi-band multi-antenna array 3 in accordance with an embodiment of the present disclosure. The ECC curves of the first antenna 311 and the second antenna 312 within the first communication band 32 is denoted as 31828, and the ECC curve of the same within the second communication band 33 is denoted as 31929. As shown in FIG. 3E, the ECC curve of the dual antenna array 31 is lower than 0.15 within the first communication band 32 and lower than 0.05 within the second communication band 33.

The communication frequency band operations and experimental data included in FIGS. 3B, 3C, 3D and 3E are merely used to demonstrate the technical effects of the multi-band multi-antenna array 3 in accordance with an embodiment of the present disclosure shown in FIG. 3A, and are not intended to limit the communication frequency band operations, applications and specifications that can be covered by the multi-band multi-antenna array 3 according to the present disclosure in practical implementations. The multi-band multi-antenna array 3 according to the present disclosure can be designed to cover the system frequency band operations of Wireless Wide Area Network (WWAN), Multi-Input Multi-Output (MIMO) System; Long Term Evolution (LTE); Pattern Switchable Antenna System; Wireless Personal Network (WLPN); Wireless Local Area Network (WLAN); Beam-Forming Antenna System, Near Field Communication (NFC); Digital Television Broadcasting System (DTV) or Global Positioning System (GPS). A multi-antenna communication device can be designed, integrated and realized with a single dual antenna array 31 or a plurality of dual antenna arrays 31 of the multi-band multi-antenna array 3 according to the present disclosure. The multi-antenna communication device can be a mobile communication device, a wireless communication device, a mobile computing device, a computer system, a telecommunications equipment, a network apparatus, or a computer or network peripheral.

Figure 4A:
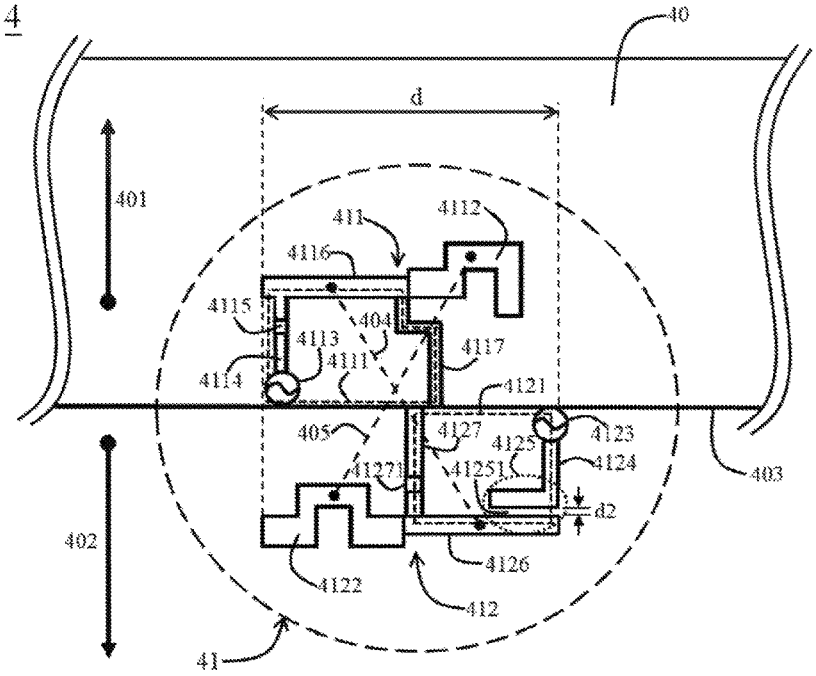
FIG. 4A is a structural diagram of a multi-band multi-antenna array 4 in accordance with an embodiment of the present disclosure.
Figure 4B:
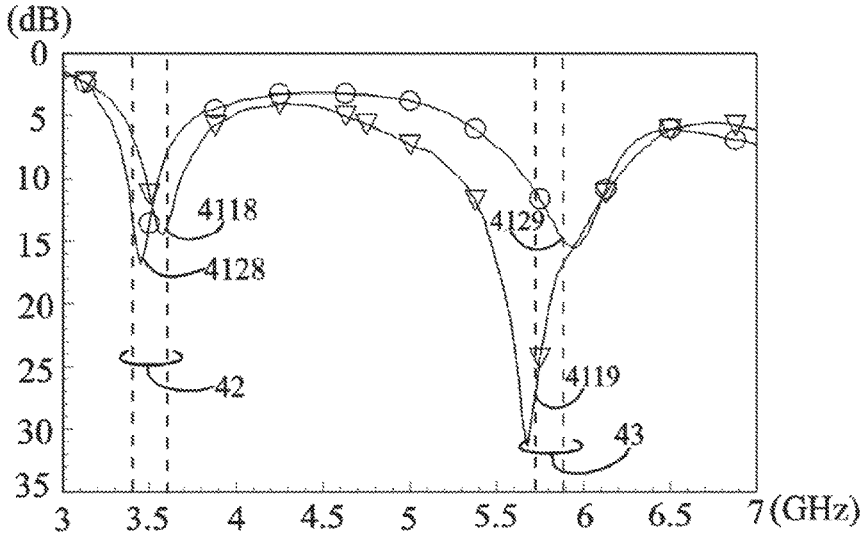
FIG. 4B is a graph depicting the return loss of a dual antenna array 41 of the multi-band multi-antenna array 4 in accordance with an embodiment of the present disclosure.

FIG. 4A is a structural diagram of a multi-band multi-antenna array 4 in accordance with an embodiment of the present disclosure. FIG. 4B is a graph depicting the return loss of a dual antenna array 41 of the multi-band multi-antenna array 4 in accordance with an embodiment of the present disclosure. As shown in FIGS. 4A and 4B, the multi-band multi-antenna array 4 includes a ground conductor plane 40 and the dual antenna array 41. The ground conductor plane 40 separates a first side space 401 and a second side space 402 opposite to the first side space 401. The ground conductor plane 40 has a first edge 403. The dual antenna array 41 is at the first edge 403. The dual antenna array 41 has a maximum array length d extending along the first edge 403. The dual antenna array 41 includes a first antenna 411 and a second antenna 412. The first antenna 411 is in the first side space 401 and includes a first resonant loop 4111 and a first radiating conductor line 4112. The first resonant loop 4111 is formed by connecting a first signal source 4113, a first feeding conductor line 4114, a first capacitive coupling portion 4115, a first resonant conductor line 4116, a first inductive grounding conductor portion 4117, and the first edge 403 in series. The first radiating conductor line 4112 is electrically connected with the first resonant conductor line 4116, and the first resonant conductor line 4116 is positioned between the first capacitive coupling portion 4115 and the first inductive grounding conductor portion 4117. The first capacitive coupling portion 4115 is a chip capacitive element. The first inductive grounding conductor portion 4117 is a meandering conductor line segment. The path length of the first resonant conductor line 4116 is between 0.33 times and 0.68 times the sum of the path lengths of the first resonant conductor line 4116 and the first radiating conductor line 4112. The first resonant loop 4111 excites the first antenna 411 to generate a first resonant mode 4118 (as shown in FIG. 4B), the first radiating conductor line 4112 excites the first antenna 411 to generate a second resonant mode 4119 (as shown in FIG. 4B), and the frequencies of the first resonant mode 4118 are lower than the frequencies of the second resonant mode 4119. The second antenna 412 is in the second side space 402, and includes a second resonant loop 4121 and a second radiating conductor line 4122. The second resonant loop 4121 is formed by connecting a second signal source 4123, a second feeding conductor line 4124, a second capacitive coupling portion 4125, a second resonant conductor line 4126, a second inductive grounding conductor portion 4127, and the first edge 403 in series. The second radiating conductor line 4122 is electrically connected with the second resonant conductor line 4126, and the second resonant conductor line 4126 is positioned between the second capacitive coupling portion 4125 and the second inductive grounding conductor portion 4127. The second capacitive coupling portion 4125 is formed as a result of mutual coupling of the second feeding conductor line 4124 and the second resonant conductor line 4126, and there is a second coupling slit 41251 between the second feeding conductor line 4124 and the second resonant conductor line 4126. The second inductive grounding conductor portion 4127 is a conductor line segment including a chip inductive element 41271. The path length of the second resonant conductor line 4126 is between 0.33 times and 0.68 times the sum of the path lengths of the second resonant conductor line 4126 and the second radiating conductor line 4122. The second resonant loop 4121 excites the second antenna 412 to generate a third resonant mode 4128 (as shown in FIG. 4B), the second radiating conductor line 4122 excites the second antenna 412 to generate a fourth resonant mode 4129 (as shown in FIG. 4B), and the frequencies of the third resonant mode 4128 are lower than the frequencies of the fourth resonant mode 4129. The connection line 404 of centers of the first resonant conductor line 4116 and the second resonant conductor line 4126 must intersect the connection line 405 of centers of the first radiating conductor line 4112 and the second radiating conductor line 4122. The first resonant mode 4118 and the third resonant mode 4128 cover at least one identical first communication band 42 (as shown in FIG. 4B), while the second resonant mode 4119 and the fourth resonant mode 4129 cover at least one identical second communication band 43 (as shown in FIG. 4B). The frequencies of the first communication band 42 are lower than those of the second communication band 43. The maximum array length d of the dual antenna array 41 extending along the first edge 403 is between 0.1 and 0.33 of the wavelength of the lowest operating frequency of the first communication band 42. The gap d2 of the second coupling slit 41251 is also between 0.001 wavelength and 0.039 wavelength of the lowest operating frequency of the first communication band 42. The path lengths of the first resonant loop 4111 and the second resonant loop 4121 are both between 0.15 wavelength and 0.35 wavelength of the lowest operating frequency of the first communication band 42. The path lengths of the first radiating conductor line 4112 and the second radiating conductor line 4122 are both between 0.06 wavelength and 0.21 wavelength of the lowest operating frequency of the second communication band 43. The first signal source 4113 and the second signal source 4123 could be RF circuit modules, RF IC chips, RF circuit switches, RF filter circuits, RF duplexer circuits, RF transmission line circuits or RF capacitor, inductor, or resistor-matching circuits.

Although in the dual antenna array 41 the first radiating conductor line 4112 is different in shape from the first radiating conductor line 3112 in the dual antenna array 31, its first capacitive coupling portion 4115 is realized with a chip capacitive element, its second inductive grounding conductor portion 4127 is realized by a conductor line segment including a chip inductive element 41271, and its implementation is different from the dual antenna array 31, the dual antenna array 41 of this embodiment similarly configures the first resonant loop 4111 and the second resonant loop 4121 for excitation to generate the first resonant mode 4118 and the third resonant mode 4128 of lower frequency bands, respectively, to successfully cover the lower first communication band 42 (as shown in FIG. 4B) operations. Also, the first capacitive coupling portion 4115 and the second capacitive coupling portion 4125 are configured such that the path lengths of first resonant loop 4111 and the second resonant loop 4121 are both between 0.15 wavelength and 0.35 wavelength of the lowest operating frequency of the first communication band 42, thereby achieving the technical effect of minimization. The first capacitive coupling portion 4115 (or the second capacitive coupling portion 4125) and the first inductive grounding conductor portion 4117 (or the second inductive grounding conductor portion 4127) of this embodiment are similarly capable of forming an equivalent feeding matching circuit of the first radiating conductor line 4112 (or the second radiating conductor line 4122) at a higher frequency band, such that the second resonant mode 4119 (or the fourth resonant mode 4129) at a higher frequency band could be successfully excited and generated to cover the higher second communication band 43 (as shown in FIG. 4B) operations. As a result, multi-band operations could be achieved. Moreover, the equivalent feeding matching circuits of the first radiating conductor line 4112 and the second radiating conductor line 4122 are configured such that the path lengths of the first radiating conductor line 4112 and the second radiating conductor line 4122 are effectively reduced, both between 0.06 wavelength and 0.21 wavelength of the lowest operating frequency of the second communication band 43. The multi-band multi-antenna array 4 according to the present disclosure successfully staggers the first resonant loop 4111 and the second resonant loop 4121 at two sides of the ground conductor plane 40 without overlapping completely by similarly arranging them such that the connection line 404 of centers of the first resonant conductor line 4116 and the second resonant conductor line 4126 must intersect the connection line 405 of centers of the first radiating conductor line 4112 and the second radiating conductor line 4122, thereby effectively reducing the level of energy coupling between the first resonant mode 4118 and the third resonant mode 4128 of the lower frequency band. Similarly, the multi-band multi-antenna array 4 according to the present disclosure successfully staggers the first radiating conductor line 4112 and the second radiating conductor line 4122 at two sides of the ground conductor plane 40 without overlapping completely, thereby effectively reducing the level of energy coupling between the second resonant mode 4119 and the fourth resonant mode 4129 of the higher frequency band. As a result, the maximum array length d of the dual antenna array 41 extending along the first edge 403 could be effectively reduced to between 0.1 wavelength and 0.33 wavelength of the lowest operating frequency of the first communication band 42. Thus, the multi-band multi-antenna array 4 of this embodiment is capable of achieving the technical effects of minimization and high level of integration similar to those achieved by the multi-band multi-antenna array 3 in the previous embodiment.

FIG. 4B is a graph depicting the return loss of the dual antenna array 41 of the multi-band multi-antenna array 4 in accordance with an embodiment of the present disclosure. The following dimensions were used for the experiments: the length of the first edge 403 of the ground conductor plane 40 being about 156 mm; the width of the ground conductor plane 40 being about 75 mm; the maximum arrange length d of the dual antenna array 41 extending along the first edge 403 being about 16.6 mm; the path length of the first resonant loop 4111 being about 22.2 mm; the path length of the second resonant loop 4121 being about 21.3 mm; the path length of the first radiating conductor line 4112 being about 8.6 mm; the path length of the second radiating conductor line 4122 being about 9.3 mm; the path length of the first resonant conductor line 4116 being about 7.3 mm; the path length of the second resonant conductor line 4126 being about 7.2 mm; the path length of the first inductive grounding conductor portion 4117 being about 4.05 mm; the path length of the second inductive grounding conductor portion 4127 being about 3.1 mm; the inductance of the chip inductive element 41271 being about 1.8 nH; the capacitance of the chip capacitive element of the first capacitive coupling portion 4115 being about 1.5 pF; and the gap d2 of the second coupling slit 41251 being about 0.39 mm. As shown in FIG. 4B, the first resonant loop 4111 excites the first antenna 411 to generate the first resonant mode 4118; the first radiating conductor line 4112 excites the first antenna 411 to generate the second resonant mode 4119; and the frequencies of the first resonant mode 4118 are lower than those of the second resonant mode 4119. The second resonant loop 4121 excites the second antenna 412 to generate the third resonant mode 4128; the second radiating conductor line 4122 excites the second antenna 412 to generate the fourth resonant mode 4129; and the frequencies of the third resonant mode 4128 are lower than those of the fourth resonant mode 4129. In this embodiment, the first resonant mode 4118 and the third resonant mode 4128 cover the same first communication band 42 (3400 MHz-3600 MHz), the second resonant mode 4119 and the fourth resonant mode 4129 cover the same second communication band 43 (5725 MHz-5875 MHz), and the frequency of the first communication band 42 is less than that of the second communication band 43. The lowest operating frequency of the first communication band 42 is approximately 3400 MHz, while the lowest operating frequency of the first communication band 43 is approximately 5725 MHz.

Figure 4C:
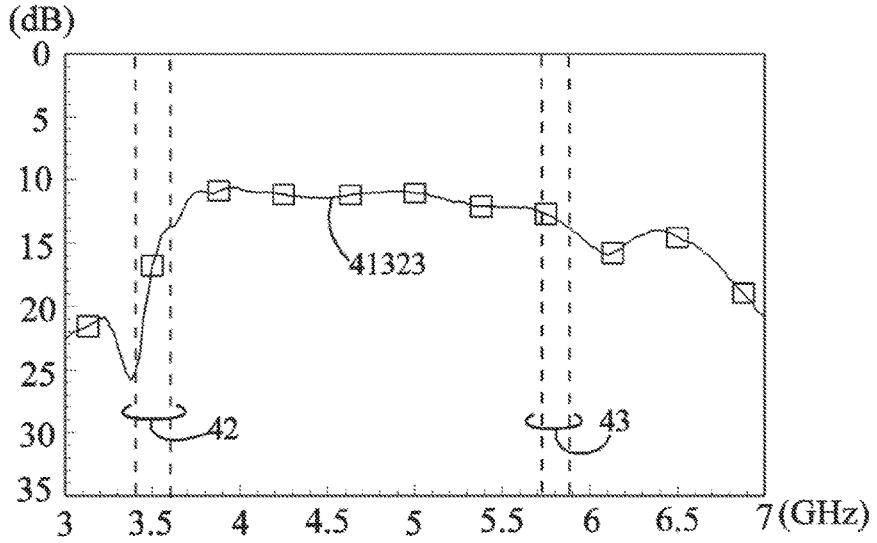
FIG. 4C is a graph depicting an isolation curve of the dual antenna array 41 of the multi-band multi-antenna array 4 in accordance with an embodiment of the present disclosure.
Figure 4D:
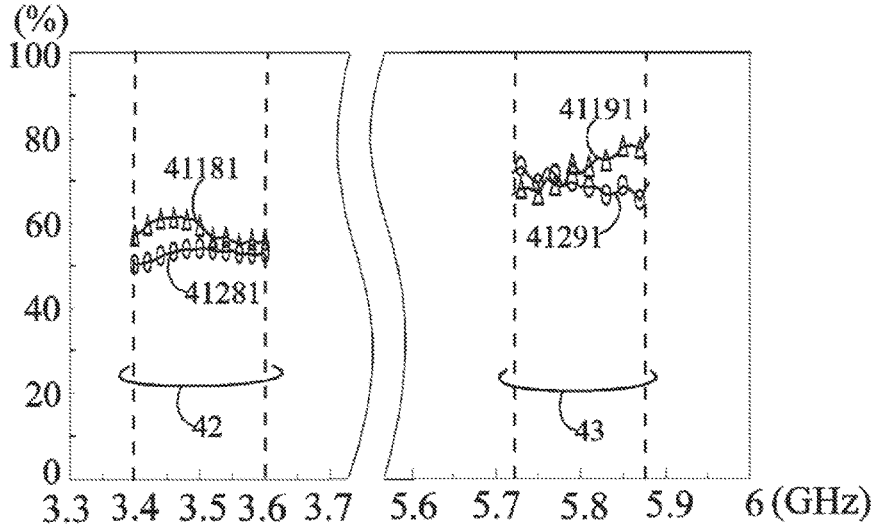
FIG. 4D is a graph depicting radiation efficiency curves of the dual antenna array 41 of the multi-band multi-antenna array 4 in accordance with an embodiment of the present disclosure.
Figure 4E:
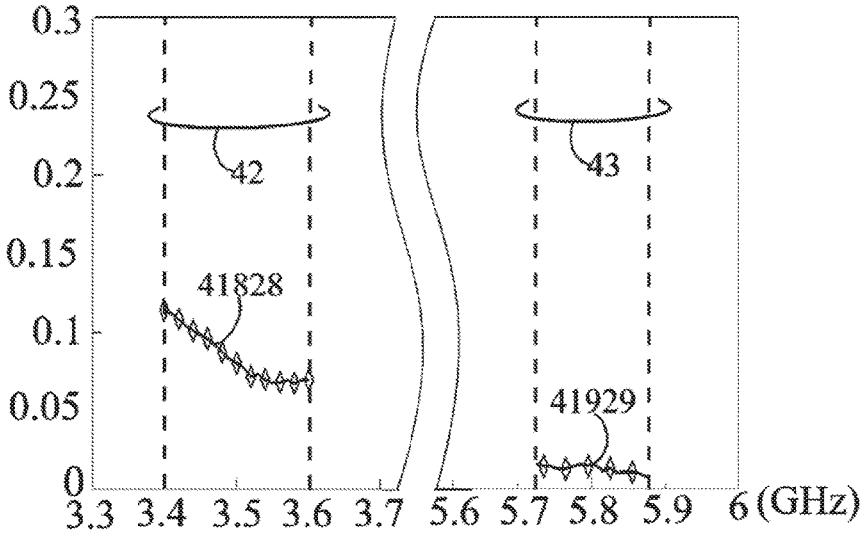
FIG. 4E is a graph depicting envelop correlation coefficient (ECC) curves of the dual antenna array 41 of the multi-band multi-antenna array 4 in accordance with an embodiment of the present disclosure.

FIG. 4C is a graph depicting an isolation curve of the dual antenna array 41 of the multi-band multi-antenna array 4 in accordance with an embodiment of the present disclosure. The isolation curve between the first antenna 411 and the second antenna 412 is denoted as 41323. As shown in FIG. 4C, the isolation curve 41323 of the dual antenna array 41 is higher than 13 dB within the first communication band 42 and is also higher than 11 dB within the second communication band 43, thereby demonstrating good isolation performance. FIG. 4D is a graph depicting radiation efficiency curves of the dual antenna array 41 of the multi-band multi-antenna array 4 in accordance with an embodiment of the present disclosure. The radiation efficiency curves of the first antenna 411 within the first communication band 42 and the second communication band 43 are denoted as 41181 and 41191, respectively. The radiation efficiency curves of the second antenna 412 within the first communication band 42 and the second communication band 43 are denoted as 41281 and 41291, respectively. As shown in FIG. 4D, the radiation efficiency curve 41181 of the first antenna 411 within the first communication band 42 is above 50%, while the radiation efficiency curve 41191 thereof within the second communication band 43 is above 68%; and the radiation efficiency curve 41281 of the second antenna 412 within the first communication band 42 is above 48%, while the radiation efficiency curve 41291 thereof within the second communication band 43 is above 67%. FIG. 4E is a graph depicting envelop correlation coefficient (ECC) curves of the dual antenna array 41 of the multi-band multi-antenna array 4 in accordance with an embodiment of the present disclosure. The ECC curve of the first antenna 411 and the second antenna 412 within the first communication band 42 is denoted as 41828, and the ECC curve of the same within the second communication band 43 is denoted as 41929. As shown in FIG. 4E, the ECC curve of the dual antenna array 41 is lower than 0.12 within the first communication band 42 and lower than 0.03 within the second communication band 43.

The communication system frequency band operations and experimental data included in FIGS. 4B, 4C, 4D and 4E are merely used to demonstrate the technical effects of the multi-band multi-antenna array 4 in accordance with an embodiment of the present disclosure shown in FIG. 4A, and are not intended to limit the communication frequency band operations, applications and specifications that could be covered by the multi-band multi-antenna array 4 according to the present disclosure in actual implementations. The multi-band multi-antenna array 4 according to the present disclosure could be designed to cover the system frequency band operations of Wireless Wide Area Network (WWAN), Multi-Input Multi-Output (MIMO) System; Long Term Evolution (LTE); Pattern Switchable Antenna System; Wireless Personal Network (WLPN); Wireless Local Area Network (WLAN); Beam-Forming Antenna System, Near Field Communication (NFC); Digital Television Broadcasting System (DTV) or Global Positioning System (GPS). A multi-antenna communication device could be realized with a single dual antenna array 41 or a plurality of dual antenna arrays 41 of the multi-band multi-antenna array 4 according to the present disclosure. The multi-antenna communication device could be a mobile communication device, a wireless communication device, a mobile computing device, a computer system, a telecommunications equipment, a network apparatus, or a computer or network peripheral.

Figure 5A:
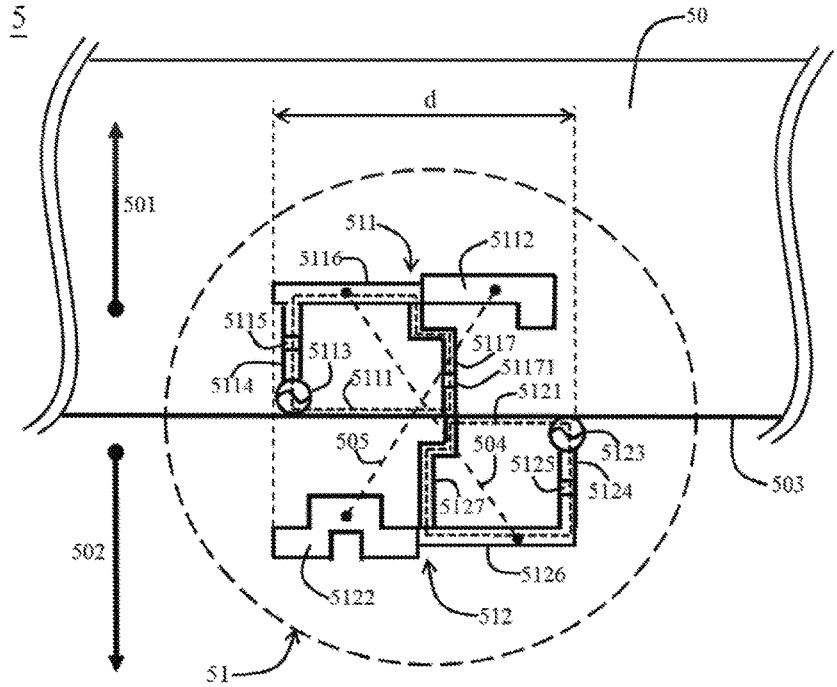
FIG. 5A is a structural diagram of a multi-band multi-antenna array 5 in accordance with an embodiment of the present disclosure.
Figure 5B:
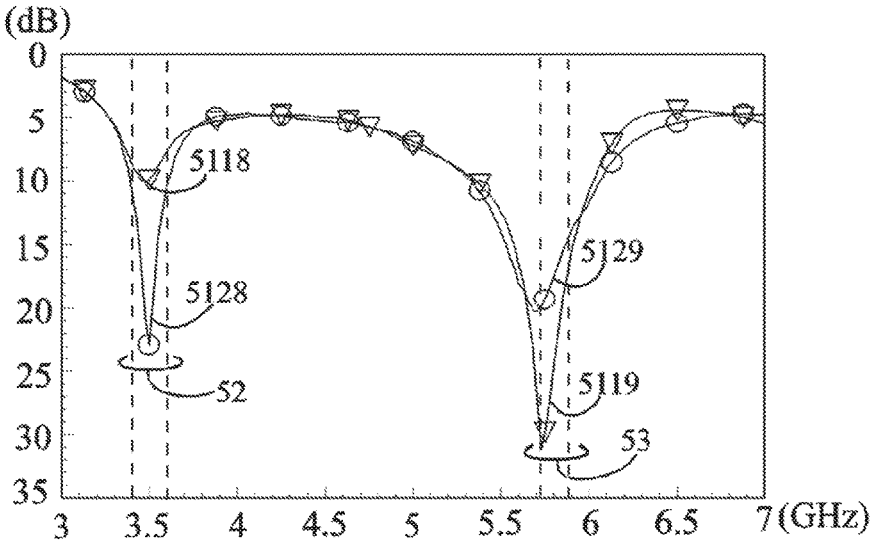
FIG. 5B is a graph depicting the return loss of a dual antenna array 51 of the multi-band multi-antenna array 5 in accordance with an embodiment of the present disclosure.

FIG. 5A is a structural diagram of a multi-band multi-antenna array 5 in accordance with an embodiment of the present disclosure. FIG. 5B is a graph depicting the return loss of a dual antenna array 51 of the multi-band multi-antenna array 5 in accordance with an embodiment of the present disclosure. As shown in FIGS. 5A and 5B, the multi-band multi-antenna array 5 includes a ground conductor plane 50 and the dual antenna array 51. The ground conductor plane 50 separates a first side space 501 and a second side space 502 opposite to the first side space 501. The ground conductor plane 50 has a first edge 503. The dual antenna array 51 is at the first edge 503. The dual antenna array 51 has a maximum array length d extending along the first edge 503. The dual antenna array 51 includes a first antenna 511 and a second antenna 512. The first antenna 511 is in the first side space 501 and includes a first resonant loop 5111 and a first radiating conductor line 5112. The first resonant loop 5111 is formed by connecting a first signal source 5113, a first feeding conductor line 5114, a first capacitive coupling portion 5115, a first resonant conductor line 5116, a first inductive grounding conductor portion 5117, and the first edge 503 in series. The first radiating conductor line 5112 is electrically connected with the first resonant conductor line 5116, and the first resonant conductor line 5116 is positioned between the first capacitive coupling portion 5115 and the first inductive grounding conductor portion 5117. The first capacitive coupling portion 5115 is a chip capacitive element. The first inductive grounding conductor portion 5117 is a conductor line segment including a chip inductive element 51171. The path length of the first resonant conductor line 5116 is between 0.33 times and 0.68 times the sum of path lengths of the first resonant conductor line 5116 and the first radiating conductor line 5112. The first resonant loop 5111 excites the first antenna 511 to generate a first resonant mode 5118 (as shown in FIG. 5B), the first radiating conductor line 5112 excites the first antenna 511 to generate a second resonant mode 5119 (as shown in FIG. 5B), and the frequencies of the first resonant mode 5118 are lower than the frequencies of the second resonant mode 5119. The second antenna 512 is in the second side space 502, and includes a second resonant loop 5121 and a second radiating conductor line 5122. The second resonant loop 5121 is formed by connecting a second signal source 5123, a second feeding conductor line 5124, a second capacitive coupling portion 5125, a second resonant conductor line 5126, a second inductive grounding conductor portion 5127, and the first edge 503 in series. The second radiating conductor line 5122 is electrically connected with the second resonant conductor line 5126, and the second resonant conductor line 5126 is positioned between the second capacitive coupling portion 5125 and the second inductive grounding conductor portion 5127. The second capacitive coupling portion 5125 is a chip capacitive element. The second inductive grounding conductor portion 5127 is a meandering conductor line segment. The path length of the second resonant conductor line 5126 is between 0.33 times and 0.68 times the sum of path lengths of the second resonant conductor line 5126 and the second radiating conductor line 5122. The second resonant loop 5121 excites the second antenna 512 to generate a third resonant mode 5128 (as shown in FIG. 5B), the second radiating conductor line 5122 excites the second antenna 512 to generate a fourth resonant mode 5129 (as shown in FIG. 5B), and the frequencies of the third resonant mode 5128 are lower than the frequencies of the fourth resonant mode 5129. The connection line 504 of centers of the first resonant conductor line 5116 and the second resonant conductor line 5126 must intersect the connection line 505 of centers of the first radiating conductor line 5112 and the second radiating conductor line 5122. The first resonant mode 5118 and the third resonant mode 5128 cover at least one identical first communication band 52 (as shown in FIG. 5B), while the second resonant mode 5119 and the fourth resonant mode 5129 cover at least one identical second communication band 53 (as shown in FIG. 5B). The frequencies of the first communication band 52 are lower than those of the second communication band 53. The maximum array length d of the dual antenna array 51 extending along the first edge 503 is between 0.1 wavelength and 0.33 wavelength of the lowest operating frequency of the first communication band 52. The path lengths of the first resonant loop 5111 and the second resonant loop 5121 are both between 0.15 wavelength and 0.35 wavelength of the lowest operating frequency of the first communication band 52. The path lengths of the first radiating conductor line 5112 and the second radiating conductor line 5122 are both between 0.06 wavelength and 0.21 wavelength of the lowest operating frequency of the second communication band 53. The first signal source 5113 and the second signal source 5123 could be RF circuit modules, RF IC chips, RF circuit switches, RF filter circuits, RF duplexer circuits, RF transmission line circuits or RF capacitor, inductor, or resistor-matching circuits.

Although in the dual antenna array 51 the first radiating conductor line 5112 and the second radiating conductor line 5122 are different in shapes from the first radiating conductor line 2112 and the second radiating conductor line 2122 in the dual antenna array 21, its first capacitive coupling portion 5115 and the second capacitive coupling portion 5125 are both realized with chip capacitive elements, its first inductive grounding conductor portion 5117 is realized by a conductor line segment including a chip inductive element 51171, and its implementation is different from the dual antenna array 21, the dual antenna array 51 of this embodiment similarly configures the first resonant loop 5111 and the second resonant loop 5121 for excitation to generate the first resonant mode 5118 and the third resonant mode 5128 of lower frequency bands, respectively, to successfully cover the lower first communication band 52 (as shown in FIG. 5B) operations. Also, the first capacitive coupling portion 5115 and the second capacitive coupling portion 5125 are configured such that the path lengths of first resonant loop 5111 and the second resonant loop 5121 are both between 0.15 wavelength and 0.35 wavelength of the lowest operating frequency of the first communication band 52, thereby achieving the technical effect of minimization. The first capacitive coupling portion 5115 (or the second capacitive coupling portion 5125) and the first inductive grounding conductor portion 5117 (or the second inductive grounding conductor portion 5127) of this embodiment are similarly capable of forming an equivalent feeding matching circuit of the first radiating conductor line 5112 (or the second radiating conductor line 5122) at a higher frequency band, such that the second resonant mode 5119 (or the fourth resonant mode 5129) at a higher frequency band could be successfully excited and generated to cover the higher second communication band 53 (as shown in FIG. 5B) operations. As a result, multi-band operations could be achieved. Moreover, the equivalent feeding matching circuits of the first radiating conductor line 5112 and the second radiating conductor line 5122 are configured such that the path lengths of the first radiating conductor line 5112 and the second radiating conductor line 5122 are effectively reduced, both between 0.06 wavelength and 0.21 wavelength of the lowest operating frequency of the second communication band 53. The multi-band multi-antenna array 5 according to the present disclosure successfully staggers the first resonant loop 5111 and the second resonant loop 5121 at two sides of the ground conductor plane 50 without overlapping completely by similarly arranging them such that the connection line 504 of centers of the first resonant conductor line 5116 and the second resonant conductor line 5126 must intersect the connection line 505 of centers of the first radiating conductor line 5112 and the second radiating conductor line 5122, thereby effectively reducing the level of energy coupling between the first resonant mode 5118 and the third resonant mode 5128 of the lower frequency band. Similarly, the multi-band multi-antenna array 5 according to the present disclosure successfully staggers the first radiating conductor line 5112 and the second radiating conductor line 5122 at two sides of the ground conductor plane 50 without overlapping completely, thereby effectively reducing the level of energy coupling between the second resonant mode 5119 and the fourth resonant mode 5129 of the higher frequency band. As a result, the maximum array length d of the dual antenna array 51 extending along the first edge 503 could be effectively reduced to between 0.1 wavelength and 0.33 wavelength of the lowest operating frequency of the first communication band 52. Thus, the multi-band multi-antenna array 5 of this embodiment is capable of achieving the technical effects of minimization and high level of integration similar to those achieved by the multi-band multi-antenna array 2 in the previous embodiment.

FIG. 5B is a graph depicting the return loss of the dual antenna array 51 of the multi-band multi-antenna array 5 in accordance with an embodiment of the present disclosure. The following dimensions were used for the experiments: the length of the first edge 503 of the ground conductor plane 50 being about 150 mm; the width of the ground conductor plane 50 being about 73 mm; the maximum arrange length d of the dual antenna array 51 extending along the first edge 503 being about 16.6 mm; the path length of the first resonant loop 5111 being about 21.7 mm; the path length of the second resonant loop 5121 being about 21.6 mm; the path length of the first radiating conductor line 5112 being about 8.3 mm; the path length of the second radiating conductor line 5122 being about 9.3 mm; the path length of the first resonant conductor line 5116 being about 7.3 mm; the path length of the second resonant conductor line 5126 being about 7.2 mm; the path length of the first inductive grounding conductor portion 5117 being about 3.7 mm; the inductance of the chip inductive element 51171 being about 1.2 nH; the path length of the second inductive grounding conductor portion 5127 being about 3.5 mm; the capacitance of the chip capacitive element of the first capacitive coupling portion 5115 being about 1.2 pF; and the capacitance of the chip capacitive element of the first capacitive coupling portion 5125 being about 1.8 pF. As shown in FIG. 5B, the first resonant loop 5111 excites the first antenna 511 to generate the first resonant mode 5118; the first radiating conductor line 5112 excites the first antenna 511 to generate the second resonant mode 5119; and the frequencies of the first resonant mode 5118 are lower than those of the second resonant mode 5119. The second resonant loop 5121 excites the second antenna 512 to generate the third resonant mode 5128; the second radiating conductor line 5122 excites the second antenna 512 to generate the fourth resonant mode 5129; and the frequencies of the third resonant mode 5128 are lower than those of the fourth resonant mode 5129. In this embodiment, the first resonant mode 5118 and the third resonant mode 5128 cover the same first communication band 52 (3400 MHz-3600 MHz), the second resonant mode 5119 and the fourth resonant mode 5129 cover the same second communication band 53 (5725 MHz-5875 MHz), the frequencies of the first communication band 52 are lower than those of the second communication band 53. The lowest operating frequency of the first communication band 52 is approximately 3400 MHz, while the lowest operating frequency of the first communication band 53 is approximately 5725 MHz.

Figure 5C:
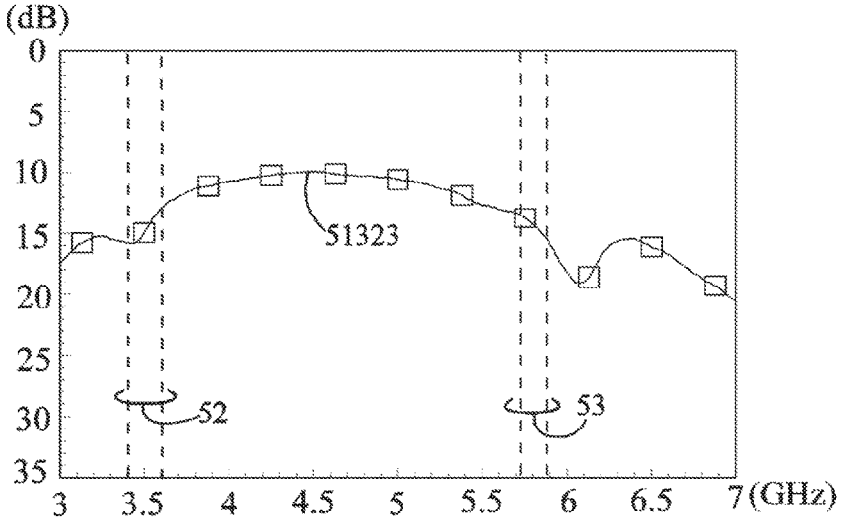
FIG. 5C is a graph depicting an isolation curve of the dual antenna array 51 of the multi-band multi-antenna array 5 in accordance with an embodiment of the present disclosure.
Figure 5D:
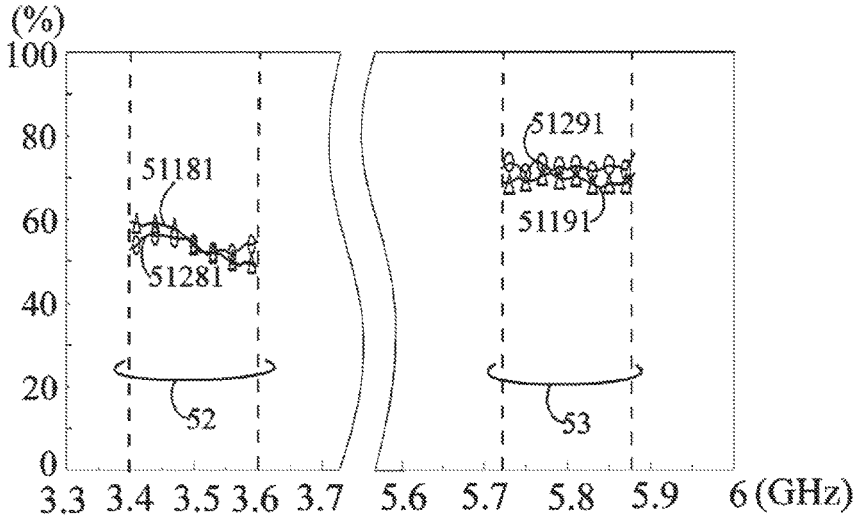
FIG. 5D is a graph depicting radiation efficiency curves of the dual antenna array 51 of the multi-band multi-antenna array 5 in accordance with an embodiment of the present disclosure.
Figure 5E:
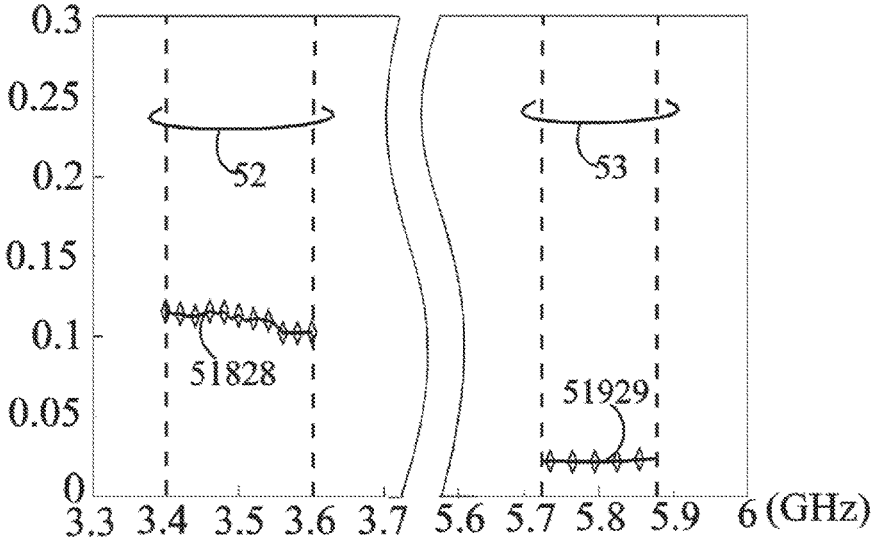
FIG. 5E is a graph depicting envelop correlation coefficient (ECC) curves of the dual antenna array 51 of the multi-band multi-antenna array 5 in accordance with an embodiment of the present disclosure.

FIG. 5C is a graph depicting an isolation curve of the dual antenna array 51 of the multi-band multi-antenna array 5 in accordance with an embodiment of the present disclosure. The isolation curve between the first antenna 511 and the second antenna 512 is denoted as 51323. As shown in FIG. 5C, the isolation curve 51323 of the dual antenna array 51 is higher than 13 dB within the first communication band 52 and is also higher than 13 dB within the second communication band 53, thereby demonstrating good isolation performance. FIG. 5D is a graph depicting radiation efficiency curves of the dual antenna array 51 of the multi-band multi-antenna array 5 in accordance with an embodiment of the present disclosure. The radiation efficiency curves of the first antenna 511 within the first communication band 52 and the second communication band 53 are denoted as 51181 and 51191, respectively. The radiation efficiency curves of the second antenna 512 within the first communication band 52 and the second communication band 53 are denoted as 51281 and 51291, respectively. As shown in FIG. 5D, the radiation efficiency curve 51181 of the first antenna 511 within the first communication band 52 is above 46%, while the radiation efficiency curve 51191 thereof within the second communication band 53 is above 65%; and the radiation efficiency curve 51281 of the second antenna 512 within the first communication band 52 is above 45%, while the radiation efficiency curve 51291 thereof within the second communication band 53 is above 65%. FIG. 5E is a graph depicting envelop correlation coefficient (ECC) curves of the dual antenna array 51 of the multi-band multi-antenna array 5 in accordance with an embodiment of the present disclosure. The ECC curve of the first antenna 511 and the second antenna 512 within the first communication band 52 is denoted as 51828, and the ECC curve of the same within the second communication band 53 is denoted as 51929. As shown in FIG. 5E, the ECC curve of the dual antenna array 51 is lower than 0.13 within the first communication band 52 and lower than 0.03 within the second communication band 53.

The communication system frequency band operations and experimental data included in FIGS. 5B, 5C, 5D and 5E are merely used to demonstrate the technical effects of the multi-band multi-antenna array 5 in accordance with an embodiment of the present disclosure shown in FIG. 5A, and are not intended to limit the communication frequency band operations, applications and specifications that could be covered by the multi-band multi-antenna array 5 according to the present disclosure in actual implementations. The multi-band multi-antenna array 5 according to the present disclosure could be designed to cover the system frequency band operations of Wireless Wide Area Network (WWAN), Multi-Input Multi-Output (MIMO) System; Long Term Evolution (LTE); Pattern Switchable Antenna System; Wireless Personal Network (WLPN); Wireless Local Area Network (WLAN); Beam-Forming Antenna System, Near Field Communication (NFC); Digital Television Broadcasting System (DTV) or Global Positioning System (GPS). A multi-antenna communication device could be realized with a single dual antenna array 51 or a plurality of dual antenna arrays 51 of the multi-band multi-antenna array 5 according to the present disclosure. The multi-antenna communication device could be a mobile communication device, a wireless communication device, a mobile computing device, a computer system, a telecommunications equipment, a network apparatus, or a computer or network peripheral.

The present disclosure provides a design method for an integrated multi-antenna communication device with low correlation coefficient characteristics to effectively reduce the overall size of the multi-antenna array applied in the communication device to satisfy the demands for multi-antenna communication devices with high transfer speeds in the future.

The above embodiments are only used to illustrate the principles of the present disclosure, and should not be construed as to limit the present disclosure in any way. The above embodiments can be modified by those with ordinary skill in the art without departing from the scope of the present disclosure as defined in the following appended claims.

What is claimed is:

1. A multi-band multi-antenna array, comprising:

a ground conductor plane including a first edge and separating a first side space and a second side space opposite to the first side space; and a dual antenna array disposed at the first edge and having a maximum array length extending along the first edge, the dual antenna array including:

a first antenna disposed in the first side space, and including a first resonant loop and a first radiating conductor line, the first resonant loop formed by connecting a first signal source, a first feeding conductor line, a first capacitive coupling portion, a first resonant conductor line, a first inductive grounding conductor portion, and the first edge in series, wherein the first radiating conductor line is electrically connected with the first resonant conductor line, the first resonant conductor is disposed between the first capacitive coupling portion and the first inductive grounding conductor portion, the first resonant loop is configured to excite the first antenna generating a first resonant mode, the first radiating conductor line is configured to excite the first antenna generating a second resonant mode, and frequencies of the first resonant mode are lower than frequencies of the second resonant mode; and a second antenna disposed in the second side space, and including a second resonant loop and a second radiating conductor line, the second resonant loop formed by connecting a second signal source, a second feeding conductor line, a second capacitive coupling portion, a second resonant conductor line, a second inductive grounding conductor portion and the first edge in series, wherein the second radiating conductor line is electrically connected with the second resonant conductor line, the second resonant conductor line is disposed between the second capacitive coupling portion and the second inductive grounding conductor portion, the second resonant loop is configured to excite the second antenna generating a third resonant mode, the second radiating conductor line is configured to excite the second antenna generating a fourth resonant mode, and frequencies of the third resonant mode are lower than frequencies of the fourth resonant mode, wherein the connection line of centers of the first resonant conductor line and the second resonant conductor line intersects the connection line of centers of the first radiating conductor line and the second radiating conductor line, the first resonant mode and the third resonant mode cover at least one identical first communication band, the second resonant mode and the fourth resonant mode cover at least one identical second communication band, frequencies of the first communication band are lower than frequencies of the second communication band, and the maximum array length of the dual antenna array extending along the first edge is between 0.1 wavelength and 0.33 wavelength of a lowest operating frequency of the first communication band.

2. The multi-band multi-antenna array of claim 1, wherein path lengths of the first resonant loop and the second resonant loop are between 0.15 wavelength and 0.35 wavelength of the lowest operating frequency of the first communication band.

3. The multi-band multi-antenna array of claim 1, wherein path lengths of the first radiating conductor line and the second radiating conductor line are between 0.06 wavelength and 0.21 wavelength of the lowest operating frequency of the second communication band.

4. The multi-band multi-antenna array of claim 1, wherein a path length of the first resonant conductor line is between 0.33 times and 0.68 times the sum of path lengths of the first resonant conductor line and the first radiating conductor line.

5. The multi-band multi-antenna array of claim 1, wherein a path length of the second resonant conductor line is between 0.33 times and 0.68 times the sum of path lengths of the second resonant conductor line and the second radiating conductor line.

6. The multi-band multi-antenna array of claim 1, wherein the first capacitive coupling portion is formed by mutual coupling of the first feeding conductor line and the first resonant conductor line, and the first feeding conductor line and the first resonant conductor line are spaced at a first coupling slit with a gap between 0.001 wavelength and 0.039 wavelength of the lowest operating frequency of the first communication band.

7. The multi-band multi-antenna array of claim 1, wherein the second capacitive coupling portion is formed by mutual coupling of the second feeding conductor line and the second resonant conductor line, and the second feeding conductor line and the second resonant conductor line are spaced at a second coupling slit with a gap between 0.001 wavelength and 0.039 wavelength of the lowest operating frequency of the first communication band.

8. The multi-band multi-antenna array of claim 1, wherein the first capacitive coupling portion is a chip capacitive element.

9. The multi-band multi-antenna array of claim 1, wherein the second capacitive coupling portion is a chip capacitive element.

10. The multi-band multi-antenna array of claim 1, wherein the first inductive grounding conductor portion is a meandering conductor line segment.

11. The multi-band multi-antenna array of claim 1, wherein the second inductive grounding conductor portion is a meandering conductor line segment.

12. The multi-band multi-antenna array of claim 1, wherein the first inductive grounding conductor portion is a conductor line segment and includes a chip inductive element.

13. The multi-band multi-antenna array of claim 1, wherein the second inductive grounding conductor portion is a conductor line segment and includes a chip inductive element.

14. The multi-band multi-antenna array of claim 1, wherein the first signal source is a radio frequency (RF) circuit module, an RF integrated circuit (IC) chip, an RF circuit switch, an RF filter circuit, an RF duplexer circuit, an RF transmission line circuit or an RF capacitor, inductor, or resistor matching circuit.

15. The multi-band multi-antenna array of claim 1, wherein the second signal source is a radio frequency (RF) circuit module, an RF integrated circuit (IC) chip, an RF circuit switch, an RF filter circuit, an RF duplexer circuit, an RF transmission line circuit or an RF capacitor, inductor, or resistor matching circuit.

* * * * *